United States Patent [19]

Schmidt et al.

[11] Patent Number: 4,561,365

[45] Date of Patent: Dec. 31, 1985

[54] APPARATUS FOR FORMING CUT SEGMENTS OF A SELECTED LENGTH WITH AT LEAST ONE FOLDED END

[76] Inventors: Volker Schmidt, 4638 Todds Rd., Lexington, Ky. 40509; Erich A. Schmidt, 2415 Liberty Rd., Lexington, Ky. 40505

[21] Appl. No.: 462,032

[22] Filed: Jan. 28, 1983

[51] Int. Cl.[4] ..... D05B 23/00

[52] U.S. Cl. ..... 112/121.27; 112/104; 112/130

[58] Field of Search ..... 112/121.27, 121.26, 112/104, 152, 130

[56] References Cited

U.S. PATENT DOCUMENTS

| | | | |
|---|---|---|---|
| 3,777,684 | 12/1973 | Friedman et al. | 112/121.27 X |
| 3,792,672 | 2/1974 | Friedman et al. | 112/104 |
| 3,841,247 | 10/1974 | Off et al. | 112/121.27 |
| 3,949,688 | 4/1976 | Andersson | 112/121.27 X |
| 4,114,544 | 9/1978 | Miyachi et al. | 112/121.27 X |
| 4,137,857 | 2/1979 | Miyachi et al. | 112/121.27 |
| 4,287,842 | 9/1981 | Breck, Jr. | 112/121.27 |
| 4,389,957 | 6/1983 | Block et al. | 112/104 X |
| 4,393,800 | 7/1983 | Hargett | 112/104 X |

*Primary Examiner*—H. Hampton Hunter

*Attorney, Agent, or Firm*—Frank C. Leach, Jr.

[57] ABSTRACT

A strip of material is advanced a first selected distance along a feed path past a cutter. Then, the free end of the strip of material is gripped by a gripper and pulled a second selected distance so that the strip of material is disposed across a path of a reciprocating frame. The frame is advanced so that a retainer holds the portion of the strip of material to be cut at the time that it is cut by the cutter. The ends of the cut segment, which is held by the retainer, are folded by two pairs of folding pins supported by the frame to form a folded loop. The folded loop is advanced to a sewing machine, when a sewing machine operator activates a switch, to position the folded loop on a sewing plate with the frame being retracted after the folded loop is clamped to the sewing plate and prior to sewing. The movements of the frame and the gripper are controlled from a single driven cam shaft having three cams thereon with one having a plurality of cam profiles. If the strip of material exceeds a predetermined thickness, the frame is prevented from being advanced to the position in which the retainer holds the portion of the strip of material to be cut prior to cutting so that the cut segment is not used as a folded loop.

30 Claims, 10 Drawing Figures

APPARATUS FOR FORMING CUT SEGMENTS OF A SELECTED LENGTH WITH AT LEAST ONE FOLDED END

This invention relates to an apparatus for folding at least one end of a segment cut from a strip of material and, more particularly, to automatic formation of a folded loop for attachment to material.

The automatic formation of folded loops and stitching the folded loops to articles of clothing such as pants, for example, so that the folded loops function as belt loops has previously been suggested. Two examples of such prior apparatuses are found in U.S. Pat. Nos. 3,699,907 to Anderson et al and 4,114,544 to Miyachi et al.

The apparatus of the aforesaid Anderson et al patent requires a plurality of steps to form and sew a belt loop. A first step is to advance a strip of material to be cut onto a pair of spaced pins on a carriage after which a piece is cut from the strip of material. The second step is to send the cut piece to a loop transfer head by the carriage so as to allow the loop transfer head to receive the cut piece.

At the loop transfer head, the cut piece is folded about the pair of spaced pins on the carriage by initially moving downwardly a pair of arms to hold the ends of the cut piece partially around the pins and then moving a pair of jaws upwardly to complete folding of the ends of the cut piece about the pins on the carriage. Next, the folded piece is delivered to a clamp assembly which advances the folded piece to a sewing machine at which the folded piece is retained by separate means or by the delivering clamp assembly. Finally, the retained folded piece is sewed by the sewing machine to a garment to which it is to be attached so as to function as a belt loop.

Thus, the apparatus of the aforesaid Anderson et al patent is quite complex and requires a substantial period of time to carry out the formation and sewing of the belt loop. Therefore, the apparatus of the aforesaid Anderson et al patent has not been practical because of its cost and the time to form and sew the belt loop.

The apparatus of the aforesaid Miyachi et al patent omitted the carriage for the cut piece and combined the folding and clamping of the cut piece in the same mechanism. However, the apparatus of the aforesaid Miyachi et al patent uses numerous air cylinders for producing its various movements so as to require a relatively large floor area. Furthermore, there is no single mechanical control arrangement to control all of the air cylinders.

The apparatus of the aforesaid Miyachi et al patent also utilizes an arrangement in which unsatisfactory cut pieces are not supplied to a sewing machine for sewing. This was not available in the apparatus of the aforesaid Anderson et al patent.

The apparatus of the present invention overcomes the problem of the apparatus of the aforesaid Miyachi et al patent using numerous air cylinders so as to require a relatively large floor area in that it does not employ air cylinders to control feeding of the strip of material for cutting and for positioning folding means to receive the ends of a cut segment to be folded to form the folded piece. The apparatus of the present invention uses a single driven shaft to mechanically control both feeding of the strip of material to be cut and positioning of the folding means to receive the ends of the cut segment to fold the ends of the cut segment.

The apparatus of the present invention employs a single driven shaft rotating through 360° each time that a signal is received from an operator at a sewing machine at which each of the folded loops is sewed to a garment. Thus, the single driven shaft directly or indirectly controls all of the functions occurring during each cycle of operation including control of the air cylinders employed for cutting the strip, holding the cut segment, and folding the cut segment.

The apparatus of the present invention also advances the strip of material past the cutting means in two steps. In the first step, the strip of material is mechanically advanced a first selected distance past the cutting means so that the free end of the strip of material protrudes beyond the cutting plane of the cutting means. Then, the free end of the strip of material is gripped by gripping means and pulled across a path along which a frame, which has means to hold the strip of material when it is cut and means to form loops at the ends of the cut segment, moves. Thus, there is no possiblity of the gripping means ever being damaged by the cutting means inadvertently being activated as could occur if the gripping means were to move between the separated cutting blades of the cutting means to grip the end of the strip of material in the manner shown and described in U.S. Pat. No. 4,048,931 to Hodgins, for example.

An object of this invention is to provide an improved apparatus for folding at least one end of a segment cut from a strip of material.

Another object of this invention is to provide an automatic belt loop attacher having all operations controlled by a single cam shaft.

Other objects of this invention will be readily perceived from the following description, claims, and drawings.

This invention relates to an apparatus for cutting a segment of a selected length from a strip of material and positioning the cut segment at a position at which the cut segment is to be attached to other material including cutting means to cut a segment of a selected length from the strip of material and feed means to feed the strip of material a first selected distance along a first path past the cutting means. Gripping means grips the strip of material after it has been fed past the cutting means the first selected distance by the feed means to pull the strip of material a second selected distance along the first path past the cutting means so that the sum of the first and second distances equals the selected length of the cut segment. Movable means is movable along a second path substantially orthogonal to the first path along which the strip of material is pulled by the gripping means with the movable means having holding means to hold the portion of the strip of material to be cut. The movable means is advanced by reciprocating means along the second path to a first position in which the holding means holds the portion of the strip to be cut. First rendering means renders the holding means effective to hold the portion of the strip of material to be cut when the cutting means cuts the strip of material to produce a cut segment held by the holding means. Second rendering means renders the gripping means ineffective after the cutting means has cut the strip of material to form the cut segment. The movable means is advanced by the reciprocating means along the second path from the first position to a second position at which the cut segment is to be attached to other material after being retained at the second position. The first rendering means renders the holding means ineffective after the cut segment has been retained at the second position. The reciprocating means retracts the movable means along the second path to a third position more remote from the second position than the first position after the holding means has been rendered ineffective.

This invention also relates to an apparatus for holding a cut segment of a selected length for positioning at a position at which the cut segment is to be attached including support and clamping means supported by the support means to clamp a portion of a strip of material to be cut prior to the strip of material being cut to produce a cut segment of a selected length with the clamping means clamping the portion of the strip of material intermediate the ends of the cut segment to be produced from the strip of material. Means mounts the support means for reciprocating movement along a path substantially orthogonal to the strip of material to be cut to produce the cut segment to be clamped by the clamping means. Means causes reciprocating movement of the support means along the path from a first position at which the cut segment is produced from the strip of material by cutting to a second at which the cut segment is to be attached to other material, from the second position to a third position more remote from the second position than the first position, and from the third position to the first position.

This invention further relates to an apparatus for cutting a segment of a selected length from a strip of material and positioning the cut segment at a position at which the cut segment is to be attached to other material including cutting means to cut a segment of a selected length from the strip of material and advancing means to advance the strip of material along a first path past the cutting means for the selected length. Movable means, which includes holding means to hold the portion of the strip of material to be cut, is movable along a second path substantially orthogonal to the first path along which the strip of material is advanced by the advancing means. Cam means controls the holding means and the movable means so that the movable means is advanced along the second path to a first position in which the holding means holds the portion of the strip of material to be cut after the advancing means has advanced the selected length of the strip of material along the first path past the cutting means and across the second path. The cam means includes means to cause the holding means to hold the portion of the strip of material to be cut when the cutting means cuts the strip of material to produce a cut segment held by the holding means. The cam means includes means to control the movement of the movable means from its first position to a second position in the same direction along the second path as the movable means was advanced from a third position to its first position and from its second position to its third position in the opposite direction after the holding means is rendered ineffective at the second position of the movable means to no longer hold the cut segment with the second position being the position at which the cut segment is attached to other material after being retained at the second position prior to the holding means being rendered ineffective.

The attached drawings illustrate a preferred embodiment of the invention, in which.

Figure 1:
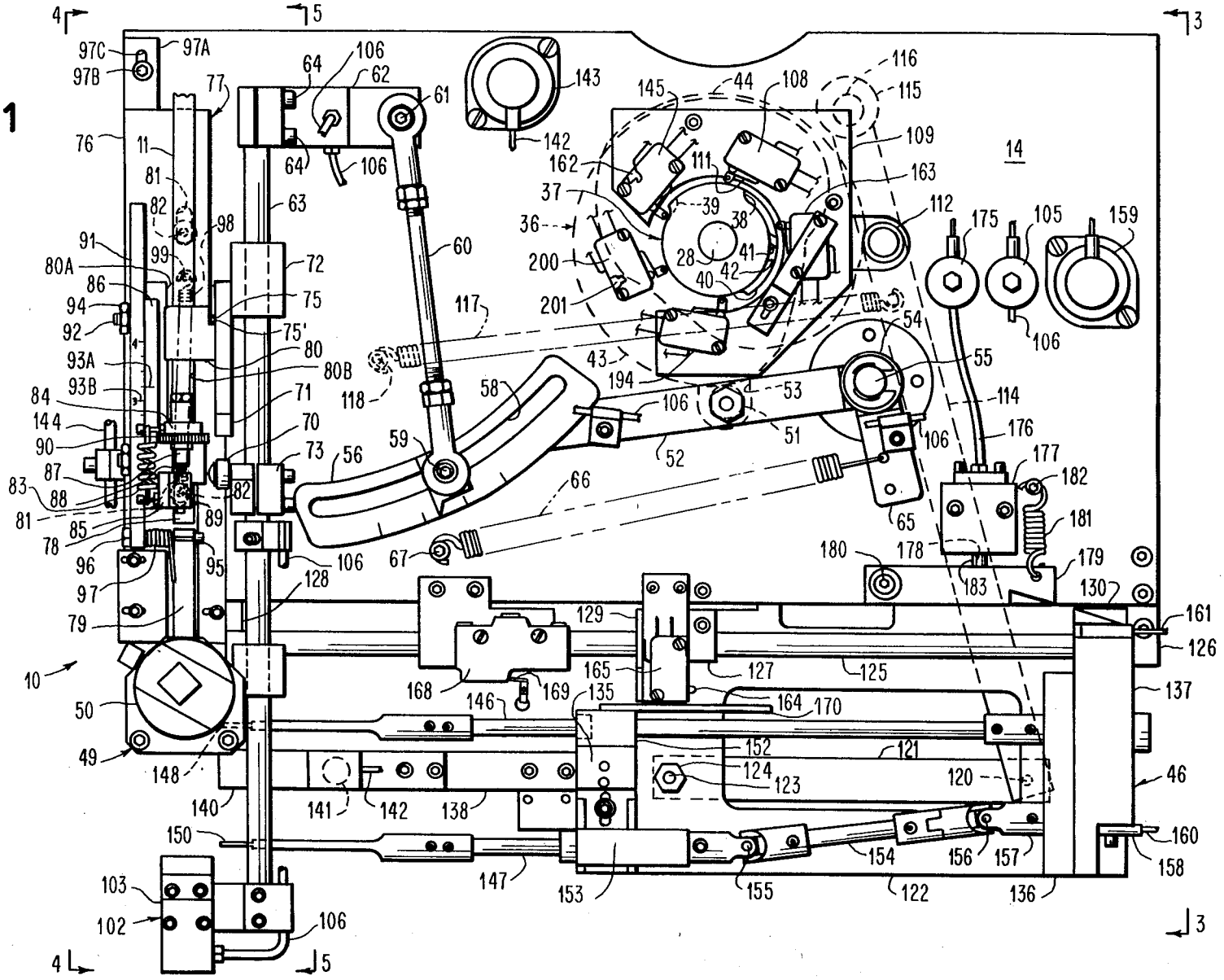
FIG. 1 is a top plan view of the apparatus of the present invention.

Referring to the drawings and particularly FIG. 1, there is shown an apparatus 10 for cutting a strip 11 of material into cut segments 12 (see FIG. 9) of a selected length with each end of each of the cut segments 12 being folded to form a looped segment such as a belt loop, for example. The strip 11 (see FIG. 1) of material may be formed, for example, by having separate portions sewed to each other at their overlapping ends. Each of the separate portions would be cut from a layer of material to be used as a pair of pants so that the belt loops from each separate portion would be sewed to the pants of the same layer of material.

The apparatus 10 includes a horizontal support platform 14, which has a pair of ears 15 (see FIG. 3) depending downwardly from its lower surface to pivotally mount the platform 14 on a horizontally disposed pivot shaft 16. The pivot shaft 16 is supported by a pair of posts 17 extending upwardly from a base 18.

The base 18 is mounted on the upper surface of a table 19. Two main lock screws 20 lock the base 18 to the table 19.

The platform 14 also is supported by a pair of posts 21 (one shown in FIG. 2) extending upwardly from the base 18. Each of the posts 21 has an adjustment screw 22 on its upper end to engage the bottom surface of the platform 14 to maintain the platform 14 in a desired position, which is usually substantially horizontal, in accordance with the position of a sewing machine 23 (see FIG. 7). The platform 14 (see FIG. 2) also is pivotable to a substantially vertical position by pivoting about the pivot shaft 16.

Figure 3:
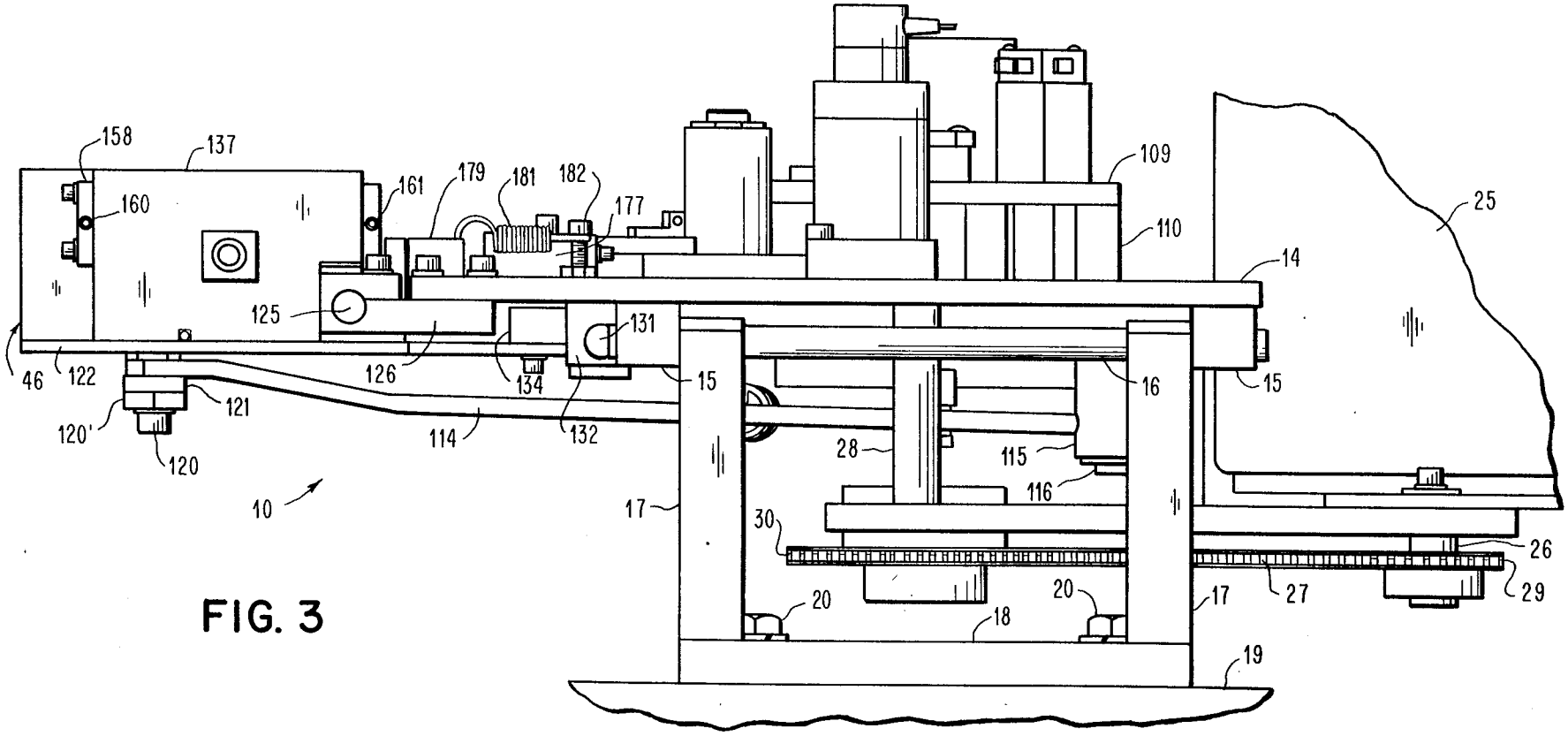
FIG. 3 is a side elevational view of the apparatus of FIG. 1 from the right side of the apparatus with parts omitted for clarity purposes and taken along line 3—3 of FIG. 1.

Each cycle of operation of the apparatus 10 begins with an operator at the sewing machine 23 (see FIG. 7) closing a switch 24 (see FIG. 6) to energize an electric motor 25 to rotate through 360°. As shown in FIG. 3, the motor 25 has its output shaft 26 connected through an endless chain 27 to a cam shaft 28, which is preferably a single shaft. The output shaft 26 has a chain sprocket 29 thereon for receiving the chain 27, and the cam shaft 28 has a chain sprocket 30 thereon for receiving the chain 27.

The cam shaft 28 extends upwardly through an opening (not shown) in the platform 14 and has a lower cam 36 (see FIG. 1) and an upper cam 37 mounted thereon for rotation therewith. The upper cam 37, which is above the platform 14, has a plurality of cam profiles 38, 39, 40, 41, and 42 thereon with the cam profile 38 being the top cam profile and the cam profile 42 being the bottom cam profile. The cam profiles 39–42 of the cam 37 are positioned beneath the uppermost cam profile 38 in descending order. It should be understood that the cam 37 could be formed so that each of the cam profiles 38–42 is on a separate cam, if desired.

The lower cam 36, which is beneath the platform 14, preferably comprises a pair of separate cams 43 and 44 with each having a cam profile although the cams 43 and 44 could be integral if desired. The cams 43 and 44 are mounted beneath the platform 14 with the cam 43 being above the cam 44.

Thus, the cam shaft 28 and the cams 37, 43, and 44 constitute a single cam means for controlling each cycle of operation of the apparatus 10. It should be understood that the cams 37, 43, and 44 could be a single cam, if desired.

The cam 43 controls the feeding of the strip 11 of material past cutting means 45 (see FIG. 2), which is supported by the platform 14, and across the path of reciprocating movement of a frame 46, which is slidably supported by the platform 14. The cutting means 45 includes a lower fixed blade 47 and an upper movable blade 48.

The lower fixed blade 47 is supported by a vertically extending frame 49, which is mounted on the platform 14. The frame 49 also slidably supports the upper movable blade 48, which is moved downwardly into cooperation with the lower fixed blade 47 to cut the strip 11 (see FIG. 1) of material by activation of an air cylinder 50 supported on the upper end of the frame 49.

The cam 43 controls the feeding of the strip 11 of material past the cutting means 45 (see FIG. 2) through cooperating with a cam follower 51 (see FIG. 1), which is mounted on the bottom surface of a link 52 and extends through a slot 53 in the platform 14 to cooperate with the cam 43 beneath the platform 14. One end of the link 52, which is disposed above the platform 14, has a hub 54 pivotally mounted on a pivot pin 55 extending upwardly from the platform 14.

The other end of the link 52 is secured to the bottom surface of an arcuate connector 56 by welding. The arcuate connector 56 has an arcuate slot 58 therein to receive a bolt 59 for pivotally connecting one end of a link 60 to the connector 56. The location of the bolt 59 in the arcuate slot 58 in the arcuate connector 56 determines the length of the strip 11 of material that is fed past the cutting means 45 (see FIG. 2) during each cycle of operation. When the bolt 59 (see FIG. 1) is retained in the portion of the arcuate slot 58 closest to the cam 36, there is a minimum advancement of the strip 11 of material during each cycle of operation while maximum feeding of the strip 11 of material occurs when the bolt 59 is retained in the edge of the arcuate slot 58 farthest from the cam 36.

The link 60 also is pivotally connected by a bolt 61 to an L-shaped block 62, which has one end of a rod 63 attached thereto by screws 64. The movement of the rod 63 in both directions along its longitudinal axis during each cycle of operation produces feeding of the strip 11 of material past the cutting means 45 (see FIG. 2).

The hub 54 (see FIG. 1) has a finger 65 extending therefrom at an angle slightly greater than 90° to the link 52. A spring 66, which has one end connected to a stud 67 extending upwardly from the platform 14 and its other end attached to the finger 65, continuously urges the cam follower 51 against the profile of the cam 43. Thus, the cam 43 controls the motion of the link 52 so as to control the motion of the rod 63.

The initial motion of the rod 63 from the position shown in FIG. 1 is towards the rear (upper portion of FIG. 1) of the platform 14. This rearward motion of the rod 63 causes a roller 70 to engage the upper end of an arm 71, which is pivotally mounted at its lower end on a guide block 72 fixed to the platform 14. The roller 70 is mounted on a support block 73, which is fixed to the rod 63. The support block 73 also has one end of a guide rod 74 (see FIG. 5), which is beneath the rod 63 and parallel thereto, secured thereto. The guide rod 74 is slidably supported in the guide block 72 and is fixed to the L-shaped block 62 to insure that the rod 63 moves along its longitudinal axis.

The pivoting of the arm 71 by the roller 70 during retraction of the rod 63 causes a lower portion 75 (see FIG. 1) of the arm 71 to engage a shoulder 75' on a plate 76, which is slidably supported by the platform 14, of a frame 77 to advance the frame 77 towards the front (lower portion of FIG. 1) of the platform 14. The plate 76 of the frame 77 has the strip 11 of material releasably clamped thereto by a pair of resiliently biased fingers 78 and 79, which are pivotally supported by the frame 77. The strip 11 of material initially passes beneath a guide 80 on the frame 77 and then beneath the fingers 78 and 79 for clamping by the fingers 78 and 79. A pair of guides 80A and 80B is mounted on the plate 76 and has the strip 11 of material pass therebetween. The guide 80A is adjustable relative to the guide 80B in accordance with the width of the strip 11 of material with the strip 11 of material riding on the edge of the guide 80B.

This movement of the plate 76 of the frame 77 advances the strip 11 of material past the cutting means 45 (see FIG. 2), which has the upper movable cutting blade 48 spaced from the lower fixed cutting blade 47 in its non-cutting position at this time. The distance that the strip 11 (see FIG. 1) of material is advanced by the roller 70 engaging the upper end of the arm 71 is controlled through the ends of a pair of slots 81 in the platform 14 engaging a pair of studs 82 extending downwardly from the plate 76 of the frame 77 and through the slots 81. The slots 81 also insure that the plate 76 of the frame 77 moves in the desired direction, which is parallel to the longitudinal axis of the rod 63.

The finger 78 is resiliently biased into engagement with the strip 11 of material on the plate 76 of the frame 77 by a spring 83. The spring 83 has one end attached to the intermediate portion of an arm 84, which has the finger 78 at its bottom end, and its other end attached to the intermediate portion of an upstanding arm 85 secured to an adjustable block 86 of the frame 77. The adjustable block 86 has the finger 78 and the arm 84 pivotally mounted thereon by a pivot pin 86' (see FIG. 5).

When the thickness of the strip 11 (see FIG. 1) of material exceeds a predetermined thickness, the arm 84 pivots clockwise (as viewed in FIG. 5) about the pin 86' against the force of the spring 83 to move an adjustment screw 87 on the upper end of the arm 84 away from engagement with a resiliently biased plunger 88 of a microswitch 89, which is mounted on the upper end of the arm 85. This enables the plunger 88 to move to a position in which the switch 89 closes to produce a signal indicating that the strip 11 (see FIG. 1) of material passing beneath the finger 78 is thicker than the predetermined maximum thickness. The position of the adjustment screw 87 relative to the plunger 88 of the microswitch 89 is adjustable in accordance with the maximum desired thickness that the strip 11 of material can be and still be used. This adjustment is produced by releasing a lock nut 90 and advancing or retracting the adjustment screw 87 in its threaded passage in the arm 84. The adjustment screw 87 is retracted from the plunger 88 to increase the maximum thickness and advanced towards the plunger 88 to decrease the maximum thickness.

The adjustable block 86 is supported by a support block 91 and is slidably adjustable relative thereto to change the position of the finger 78 along the feed path of the strip 11 of material. The support block 91 is attached to the plate 76 of the frame 77 by screws (not shown).

Figure 4:
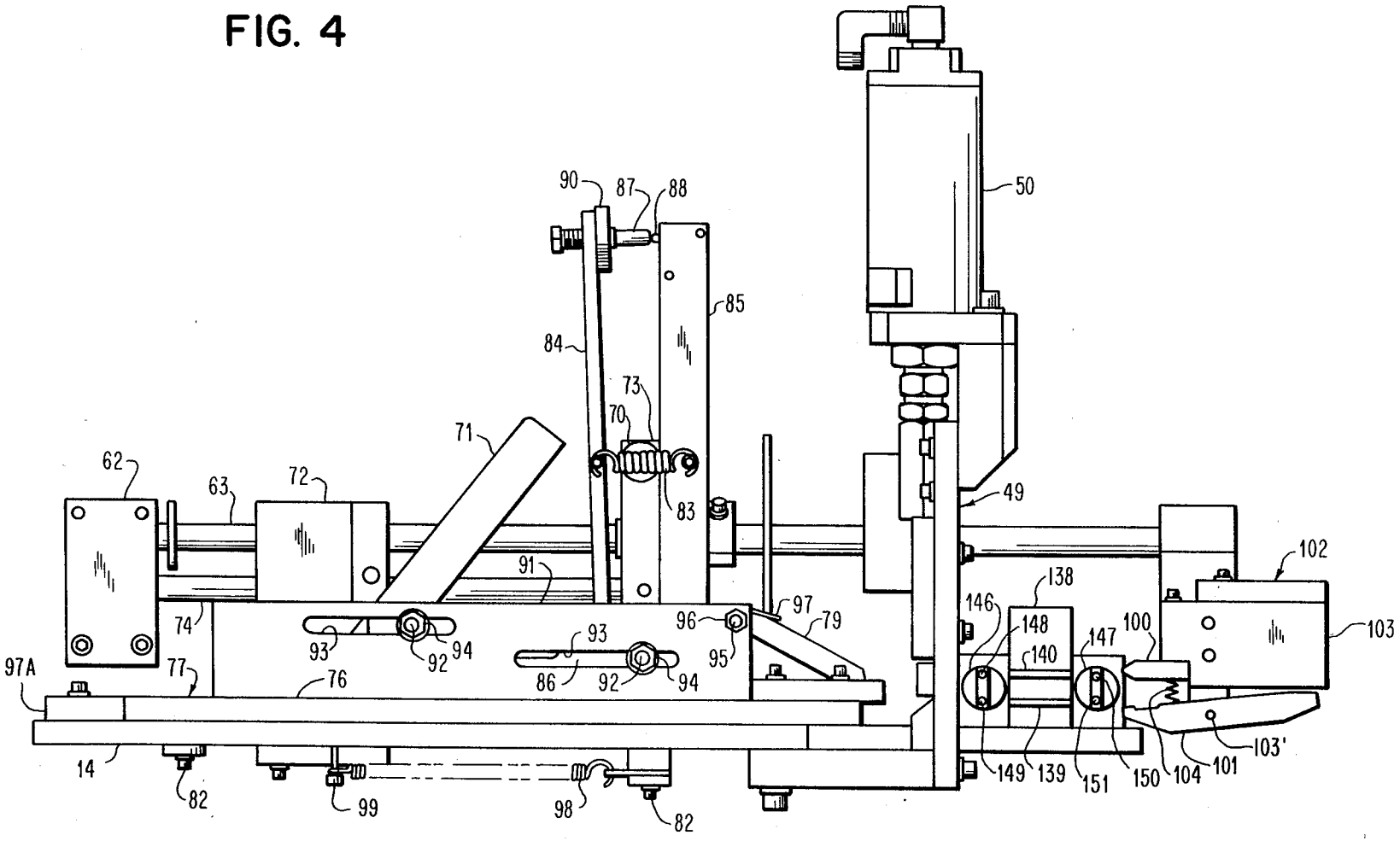
FIG. 4 is a side elevational view of a portion of the apparatus of FIG. 1 from the left side of the apparatus with parts omitted for clarity purposes and taken substantially along line 4—4 of FIG. 1.

The adjustable block 86 has bolts 92 extending therethrough and through longitudinal slots 93 (see FIG. 4) in the support block 91. This enables the adjustable block 86 (see FIG. 1) to be moved relative to the support block 91 to position the finger 78 at various locations in accordance with the length of the strip 11 of material to be cut by the cutting means 45 (see FIG. 2) during each cycle of operation. Thus, the adjustable block 86 (see FIG. 1) has a mark 93A on its upper surface for cooperation with graduations 93B on the upper surface of the support block 91 to indicate the position of the adjustable block 86 for the selected length of the strip 11 of material to be cut by the cutting means 45 (see FIG. 2) during each cycle of operation. A lock nut 94 (see FIG. 1) cooperates with each of the bolts 92 to lock the adjustable block 86 in the desired position.

The finger 79 is pivotally mounted on the support block 91 by a bolt 95 extending through passages in the finger 79 and the support block 91 and cooperating with a lock nut 96. Thus, the finger 79 is pivotally mounted on the support block 91 so that its position is not shifted as the finger 78 is when the adjustable block 86 is moved relative to the support block 91. A spring 97 surrounds the bolt 95 and has one end acting on the finger 79 to resiliently bias the finger 79 into engagement with the strip 11 of material passing therebeneath.

The frame 77 is continuously urged to the rear of the platform 14 against a stop 97A, which is mounted on the platform 14 by a screw 97B extending through a slot 97C in the stop 97A, by a spring 98, which is disposed beneath the platform 14 and has one end attached to a stud 99 extending downwardly from the lower surface of the platform 14 and its other end attached to the stud 82 extending downwardly through the forward slot 81 in the platform 14. The location of the stop 97A determines the maximum rearward position of the frame 77 relative to the cutting means 45 (see FIG. 2) so that the position of the stop 97A (see FIG. 1) determines the distance that the strip 11 of material is fed past the cutting means 45 (see FIG. 2) when the roller 70 (see FIG. 1) engages the arm 71.

When retraction of the rod 63 is completed, the strip 11 of material will have been fed a first selected distance past the cutting means 45 (see FIG. 2) through having been advanced between the lower fixed cutting blade 47 and the movable upper cutting blade 48, which is spaced from the lower fixed cutting blade 47 during this portion of the cycle of operation. At the completion of retraction of the rod 63 (see FIG. 1), the strip 11 of material has its free end, which is extending beyond the plane of the cutting blades 47 (see FIG. 2) and 48, disposed between a pair of jaws 100 (see FIG. 4) and 101 of a gripper 102, which is mounted on the end of the rod 63 remote from the L-shaped block 62.

The gripper 102 includes a support block 103 having the upper jaw 100 fixed thereto and the lower jaw 101 pivotally mounted thereon by a pin 103'. The lower jaw 101 is resiliently biased away from the upper jaw 100 by a spring 104.

Figure 5:
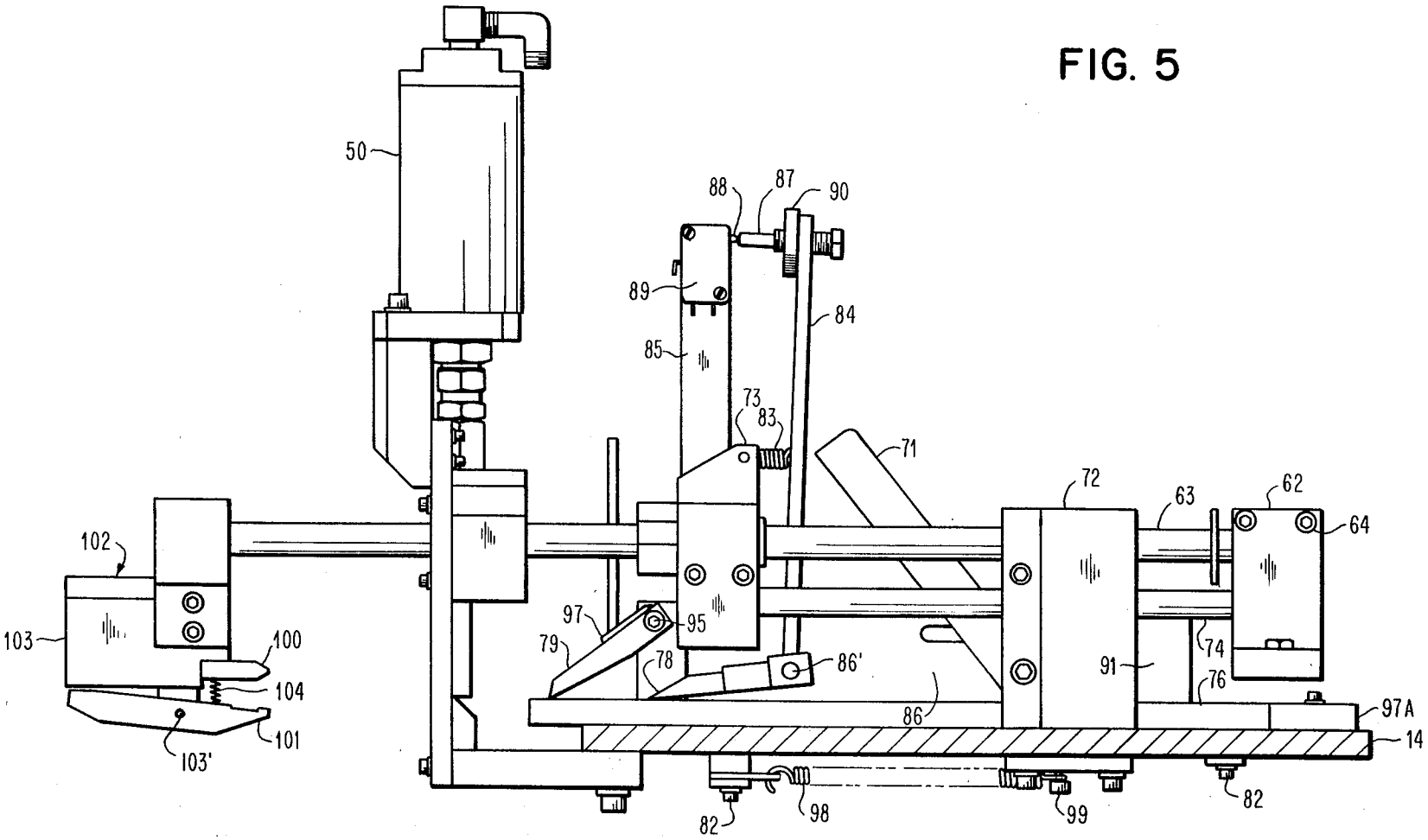
FIG. 5 is a side elevational view of a portion of the apparatus of FIG. 1 and taken substantially along line 5—5 of FIG. 1.

Accordingly, when the rod 63 (see FIG. 1) is at its maximum retraction so that the strip 11 of material has been fed past the cutting means 45 (see FIG. 2) and has its free end between the jaws 100 (see FIG. 4) and 101, pressurized air is supplied through a solenoid valve 105 (see FIG. 1) and a hose 106 to an air cylinder 107 (see FIG. 10) within the support block 103 (see FIG. 5). This causes a piston rod of the air cylinder 107 (see FIG. 10) to act on the lower jaw 101 (see FIG. 5) on the opposite side of the pivot pin 103' from the spring 104 so that the lower jaw 103 is pivoted against the force of the spring 104 to grip the free end of the strip 11 (see FIG. 1) of material between the jaws 100 (see FIG. 4) and 101.

The solenoid valve 105 (see FIG. 1) is controlled from a switch 108, which is mounted on a switch plate 109 supported above the platform 14 in spaced relation thereto by posts 110 (see FIG. 3). The switch 108 (see FIG. 1) is moved to its closed position by the cam profile 38 of the cam 37 during rotation of the cam shaft 28. Thus, the pressurized air from a source is supplied to the air cylinder 107 (see FIG. 10) in the support block 103 (see FIG. 5) when the switch 108 (see FIG. 1) has its arm 111 allowed to move to a closed position by the cam profile 38 so as to open the solenoid valve 105.

Figure 2:
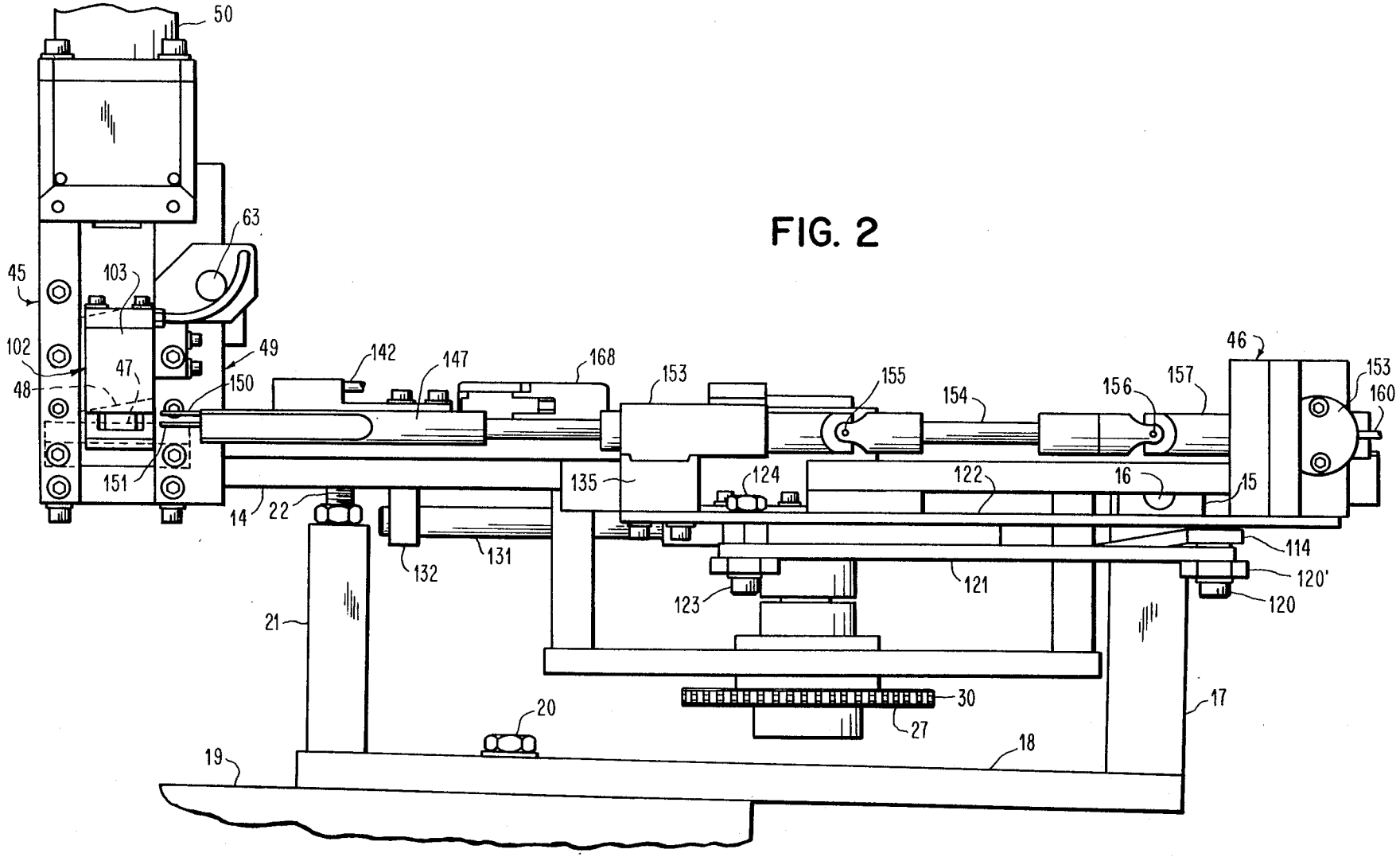
FIG. 2 is a front elevational view of the apparatus of FIG. 1.

As the cam shaft 28 continues its single revolution, the rod 63 is moved towards the front of the platform 14 to cause the strip 11 of material to be pulled past the cutting means 45 (see FIG. 2). The amount of movement of the rod 63 (see FIG. 1) towards the front of the platform 14 is controlled by the position of the bolt 59 in the arcuate slot 58 in the arcuate connector 56 as previously mentioned. Completion of pulling of the strip 11 of material by the gripper 102 is completed prior to cutting of the strip 11 of material by the cutting means 45 (see FIG. 2).

The gripper 102 (see FIG. 1) remains in the position to which it has advanced the strip 11 of material a second selected distance past the cutting means 45 (see FIG. 2) so that the sum of the first and second selected distances is equal to the selected length of the strip 11 (see FIG. 1) of material to be cut by the cutting means 45 (see FIG. 2). The gripper 102 (see FIG. 1) remains in this position during the remainder of a cycle of operation. This is the position of the apparatus 10 in FIG. 1.

The reciprocating motion of the frame 46 along its path, which is substantially orthogonal to the path along which the strip 11 of material is pulled by the gripper 102, is controlled by the profile of the cam 44 cooperating with a cam follower 112 extending upwardly from the upper surface of a link 114, which is beneath the platform 14 and has a hub 115 at one end for pivotally mounting on a stud 116 extending downwardly from the lower surface of the platform 14. A spring 117, which has one end connected to the link 114 and its other end connected to a stud 118 extending downwardly from the lower surface of the platform 14, continuously urges the cam follower 112 against the cam 44.

The other end of the link 114 is connected by a bolt 120 (see FIG. 3) and a nut 120' to one end of a link 121. The other end of the link 121 is attached to a plate 122, which is disposed in a horizontal plane beneath the horizontal plane of the platform 14 as shown in FIG. 3, of the frame 46 by a bolt 123 (see FIG. 1) and a nut 124.

The frame 46 is mounted for sliding movement along a guide rod 125, which is supported in guides 126, 127, and 128. The guides 126–128 are supported by the platform 14 as shown for the guide 126 in FIG. 3.

The plate 122 (see FIG. 1) of the frame 46 has a guide block 129 attached to its forward end and riding on the guide rod 125. The rear of the frame 46 has a second guide block 130 riding on the guide rod 125.

The frame 46 also is slidably mounted on a guide rod 131 (see FIG. 2), which is supported from the lower surface of the platform 14 by a pair of ears 132 (one shown) and is substantially parallel to the guide rod 125 (see FIG. 1). The plate 122 has a portion extending beneath the platform 14 with this portion of the plate 122 having a guide block 134 (see FIG. 3) attached to its upper surface and mounted on the guide rod 131 for sliding movement.

Thus, the guide rods 125 and 131 insure that the frame 46 reciprocates along the desired path orthogonal to the feed path of the strip 11 (see FIG. 1) of material as it is pulled by the gripper 102. Therefore, this insures that the motions from the link 114 are transformed into a reciprocating motion of the frame 46.

The plate 122 has a block 135 attached to its forward end and two blocks 136 and 137 attached to its rear end. The block 135 has an arm 138 extending forwardly therefrom and supporting a lower finger 139 (see FIG. 4) and an upper finger 140 in spaced relation to each other. An air cylinder 141 (see FIG. 1), which is supported by the arm 138, acts on the upper finger 140 to move it towards the lower finger 139 (see FIG. 4) when pressurized air is supplied through a hose 142 (see FIG. 1) from the source.

The flow of pressurized air to the air cylinder 141 is controlled by the position of a three-way valve 143, which also controls the supply of pressurized air through a hose 144 to the air cylinder 50 for activating the cutting means 45 (see FIG. 2). At the same time, air is removed from the other end of the air cylinder 50 through a hose 144' (see FIG. 10). One suitable example of the three-way valve 143 is sold by Clippard Instrument Laboratory, Inc., Cincinnati, Ohio as model 481.

Opening of a normally closed switch 145 (see FIG. 1) by the cam profile 39 closes a solenoid valve 145' (see FIG. 6) to cause movement of the valve 143 (see FIG. 1) to the position in which the upper finger 140 is moved towards the lower finger 139 (see FIG. 4) and the cutting blade 48 (see FIG. 2) is moved into cutting engagement with the cutting blade 47. Thus, when the finger 140 is moved into engagement with the finger 139 (see FIG. 4) to retain the strip 11 (see FIG. 1) of material therebetween while it is gripped at its free end by the gripper 102, the upper cutting blade 48 (see FIG. 2) is moved towards the lower cutting blade 47 to cut the strip 11 (see FIG. 1) of material to produce the cut segment 12 (see FIG. 9) of the selected length. Therefore, this retaining or holding of the strip 11 (see FIG. 1) of material by the fingers 139 (see FIG. 4) and 140 and the cutting of the strip 11 (see FIG. 1) of material can only occur after the fingers 139 (see FIG. 4) and 140 have been disposed on opposite sides of the strip 11 (see FIG. 1) of material by advancing the frame 46 to the left in FIG. 1 from the position shown in FIG. 1.

The frame 46 also has a pair of arms 146 and 147 extending therefrom and substantially parallel to each other. The arm 146 has a pair of pins 148 and 149 (see FIG. 4) mounted thereon at its free end and the arm 147 has a pair of pins 150 and 151 mounted at its free end. While the pins 148–151 are shown circular in cross section, it should be understood that the pins 148–151 may have other sectional shapes and that all of the pins 148–151 do not have to have the same sectional shape.

Accordingly, when the frame 46 is advanced to the left in FIG. 1 to have the strip 11 of material, which has its free end retained by the gripper 102, enter between the fingers 139 (see FIG. 4) and 140, the strip 11 (see FIG. 1) of material also enters between the pins 148 (see FIG. 4) and 149 on the arm 146 and the pins 150 and 151 on the arm 147.

After the strip 11 (see FIG. 1) of material is cut and the gripper 102 ceases to grip the end of the strip 11 of material because of the switch 108 being moved to its open position by the cam profile 38 of the cam 37 so that the solenoid valve 105 is closed whereby the spring 104 (see FIG. 5) moves the lower jaw 101 away from the upper jaw 100, each of the arms 146 (see FIG. 1) and 147 is rotated more than 180° but less than 270°. This wraps the ends of the cut segment 12 (see FIG. 9) about the pins 149 and 151 to form the looped ends.

The arm 146 (see FIG. 1) extends through a bearing block 152, which is supported by the plate 122, and the block 136 into the block 137. The end of the arm 146 has a shaft (not shown) with two pinion gears (not shown) thereon within the block 137 with one of the pinion gears cooperating with a rack (not shown) within the block 137.

The arm 147 extends through a block 153, which is adjustably mounted on the block 135. This enables the arm 147 to be adjustable relative to the arm 146 to accommodate various lengths of the cut segment 12 (see FIG. 9).

The arm 147 (see FIG. 1) is connected to one end of a connecting arm 154 by a universal joint 155. The other end of the arm 154 is connected by a universal joint 156 to an arm 157, which extends into the blocks 136 and 137.

The arm 157 has a pinion gear (not shown) thereon for cooperation with the pinion gear on the shaft on the arm 146 not cooperating with the rack so that the arm 147 is rotated at the same time and the same speed as the arm 146 but in the opposite direction. The rotation of the arms 146 and 147 in opposite directions folds the ends of the cut segment 12 (see FIG. 9) to form the looped ends so that the cut segment 12 may function as a belt loop.

Figure 9:
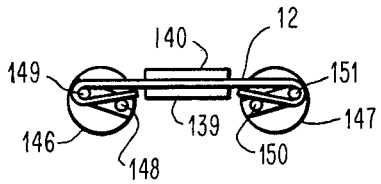
FIG. 9 is a fragmentary side elevational view of a portion of the apparatus and showing the cut segment after its ends have been folded.

The arms 146 (see FIG. 1) and 147 are rotated when pressurized air is supplied to an air cylinder 158, which is supported by the block 137, to move the rack in one direction to rotate the arms 146 and 147 to fold the ends of the cut segment 12 (see FIG. 9). The pressurized air is supplied from the source through a three-way valve 159 (see FIG. 1) and a hose 160. At the same time, air is removed from the opposite end of the air cylinder 158 through a hose 161.

The shifting of the three-way valve 159, which is the same as the three-way valve 143, between its two positions is controlled by the cam profile 40 of the cam 37 cooperating with a switch 162, which is disposed beneath the switch 145 and supported by the switch plate 109. The cam profile 40 of the cam 37 is designed so that it does not close the switch 162 until after the strip 11 of material has been cut.

Figure 10:
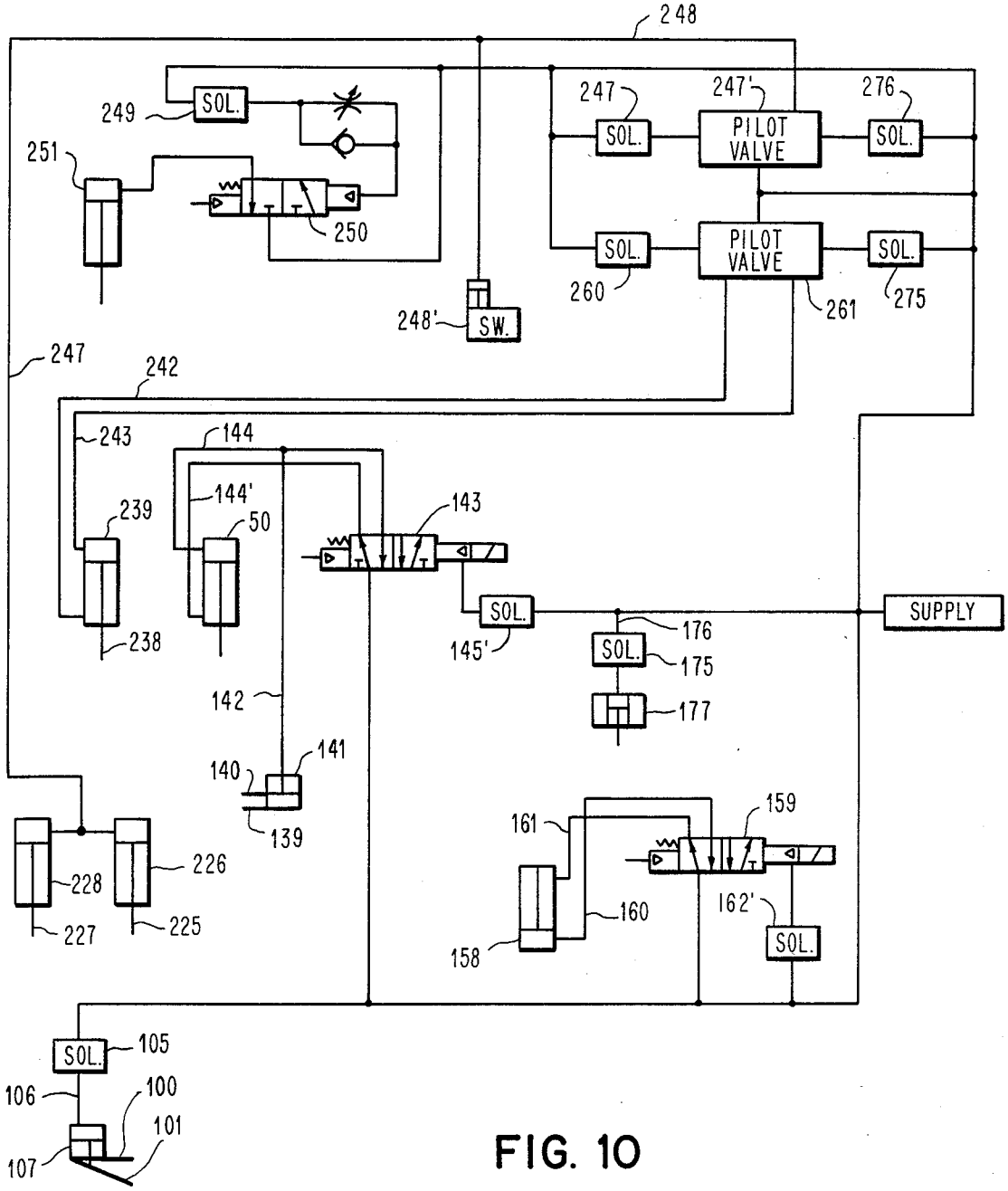
FIG. 10 is a schematic diagram of a pressurized air system for controlling various movements of the apparatus of the present invention.

The closing of the switch 162 by the cam profile 40 of the cam 37 causes energization of a solenoid valve 162', (see FIG. 10). This energization of the solenoid valve 162' causes pressurized air to be supplied through the hose 160 to the air cylinder 158 and removed from the air cylinder 158 through the hose 161.

The cam profile 40 (see FIG. 1) of the cam 37 maintains the switch 162 closed until the frame 46 is retracted to the position of FIG. 1. When the switch 162 is opened, the solenoid valve 162' (see FIG. 10) is closed so that the three-way valve 159 is shifted to its other position to allow pressurized air to be supplied to the air cylinder 158 through the hose 161 and withdrawn from the air cylinder 158 through the hose 160 to rotate the pins 148 (see FIG. 4) and 149 and the pins 150 and 151 to the position in which they receive the strip 11 (see FIG. 1) of material prior to it being cut.

After the folding of the ends of the cut segment 12 (see FIG. 9) has been completed, the cam profile 41 (see FIG. 1) of the cam 37 opens a switch 163, which is supported by the switch plate 109, to cause inactivation of the motor 25 (see FIG. 3). This stops a cycle of operation with the cut segment 12 (see FIG. 9) having its ends folded around the pins 149 and 151 and retained between the fingers 139 and 140. The movable cutting blade 48 (see FIG. 2) is in engagement with the lower cutting blade 47 at the completion of the cycle of operation.

When the operator starts another cycle by closing the switch 24 (see FIG. 6) to energize the motor 25, the folded cut segment 12 (see FIG. 9) is moved to the sewing machine 23 (see FIG. 7) by the frame 46 (see FIG. 1) being advanced to the left in FIG. 1. When the block 136 on the frame 46 engages a plunger 164 of a switch 165, which is supported by the platform 14, the folded cut segment 12 (see FIG. 9) is clamped at the sewing machine 23 (see FIG. 7). The cam 44 (see FIG. 1) controls the movement of the frame 46 so that it retracts after the switch 165 is closed whereby the folded cut segment 12 (see FIG. 9) is held at the sewing machine 23 (see FIG. 7) while the frame 46 (see FIG. 1) is retracted.

However, sewing at the sewing machine 23 (see FIG. 7) cannot begin until a switch 168 (see FIG. 1) has its resiliently biased arm 169 moved inwardly by a plate 170 on the frame 46 to close the switch 168, which does not have its on-off state changed when the frame 46 is advanced to the left in FIG. 1. Thus, sewing cannot begin at the sewing machine 23 (see FIG. 7) until there has been retraction of the frame 46 (see FIG. 1) sufficiently to have the pins 148–151 (see FIG. 9) withdrawn from the folded cut segment 12 and the fingers 139 and 140 withdrawn from the folded cut segment 12.

When the switch 165 (see FIG. 1) is closed, the three-way valve 143 has its position changed through the switch 145 being opened by the cam profile 39 to open the solenoid valve 145' (see FIG. 10). This releases the fingers 139 (see FIG. 9) and 140 from clamping engagement with the folded cut segment 12 and also retracts the upper cutting blade 48 (see FIG. 2) from the lower cutting blade 47. The finger 140 (see FIG. 4) is resiliently biased away from the finger 139 when pressurized air is no longer supplied through the hose 142 (see FIG. 10). The air cylinder 50 has air removed through the hose 144 and supplied through the hose 144' to shift the piston within the air cylinder 50 to raise the upper cutting blade 48 (see FIG. 2) away from the lower cutting blade 47.

If the switch 89 (see FIG. 1) is closed by the strip 11 of material exceeding the predetermined thickness so as to move the adjustement screw 87 of the arm 84 away from the plunger 88 of the switch 89, then the frame 46 is prevented from moving forward during the next cycle of operation. This is because the finger 78 senses the thickness of the strip 11 of material in the cycle of operation prior to that in which the sensed portion of the strip 11 of material is cut.

If the strip 11 of material has a thickness exceeding the predetermined thickness, then during the next cycle of operation, a solenoid valve 175 is energized to supply pressurized air through a hose 176 from the source to an air cylinder 177, which is supported on the platform 14. The air cylinder 177 has a rod 178 attached to its piston and movable into engagement with a latch 179, which is pivotally mounted on the platform 14 by a bolt 180. A spring 181, which has one end attached to the latch 179 and its other end connected to a stud 182 extending upwardly from the platform 14, continuously biases the latch 179 to the position of FIG. 1 in which it engages the end of an annular sleeve 183 within which the rod 178 reciprocates.

Thus, when pressurized air is supplied to the air cylinder 177, the force of the spring 181 is overcome, and the latch 179 is pivoted clockwise about the axis of the pin 180 to be disposed in the path of travel of the frame 46. This prevents advancement of the frame 46 to the position in which the fingers 139 (see FIG. 4) and 140, the pins 148 and 149, and the pins 150 and 151 would be disposed on opposite sides of the strip 11 (see FIG. 1) of material. Therefore, with the latch 179 preventing the frame 46 from being advanced to the left in FIG. 1, the cutting of the strip 11 of material during the cycle of operation results in the cut segment 12 (see FIG. 9) falling into a container (not shown) beneath the path along which the strip 11 (see FIG. 1) of material is fed. Accordingly, if the cut segment 12 (see FIG. 9) exceeds the predetermined thickness, the cut segment 12 will not be utilized at the sewing machine 23 (see FIG. 7).

As previously mentioned, closing of the switch 89 (see FIG. 1) produces a signal, which is stored by the electric circuit of the present invention until after the cutting portion of the cycle and then used to prevent advancement of the frame 46 from its rear position, to indicate that the thickness of the measured portion of the strip 11 of material exceeds the predetermined thickness. This is because measuring of the thickness of the strip 11 of material by the sensor finger 78 occurs during pulling of the strip 11 of material by the gripper 102 in the prior cycle of operation to that in which cutting of the measured portion of the strip 11 of material occurs.

Figure 6:
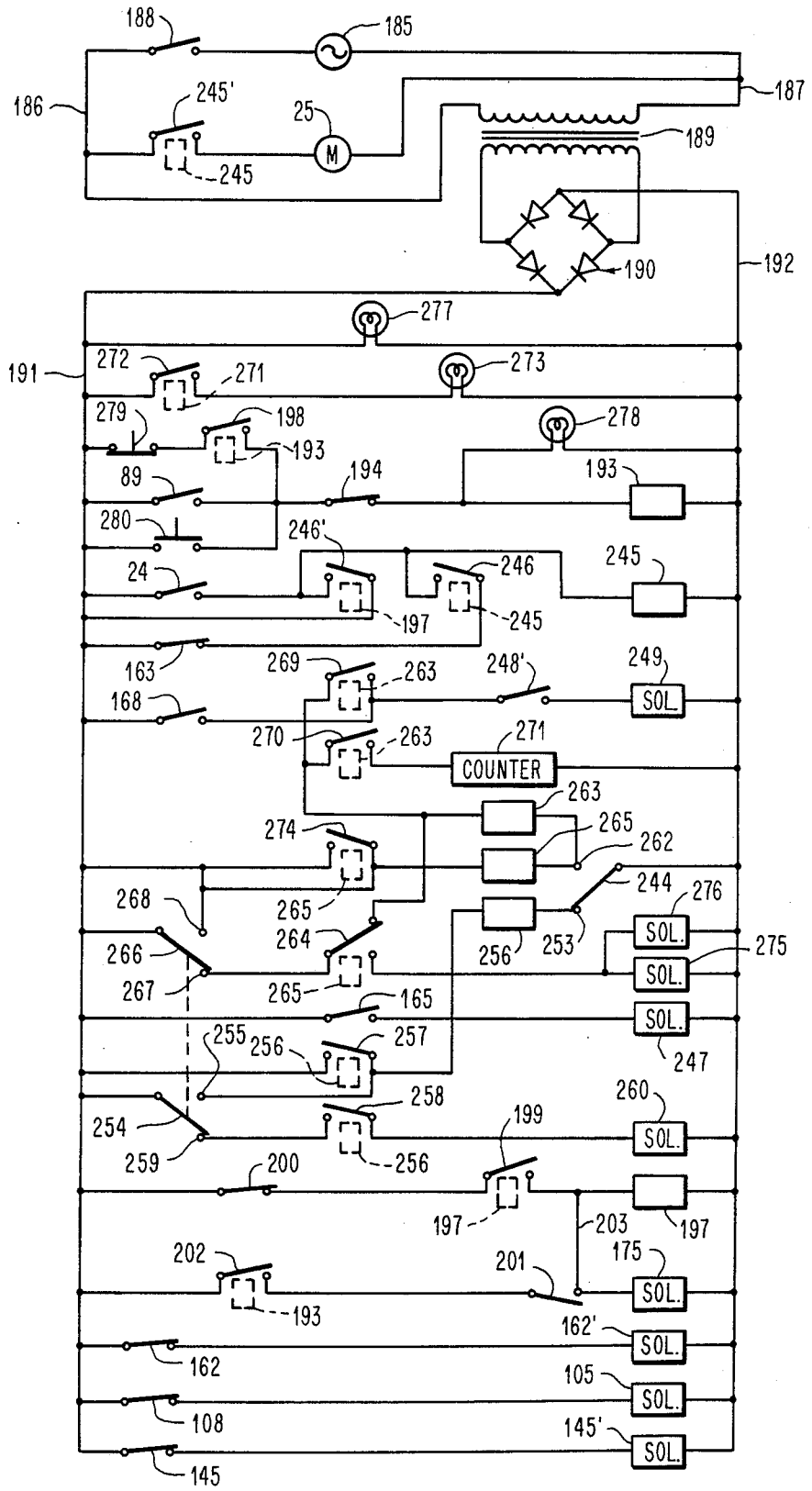
FIG. 6 is a schematic diagram of an electrical circuit used with the apparatus of the present invention.

Referring to FIG. 6, there is shown an electrical circuit of the present invention including an AC power source 185, which is connected to supply lines 186 and 187 through a switch 188. When the switch 188 is closed, a transformer 189 supplies a stepped down AC voltage, which is rectified by a full wave rectifier 190 to supply a DC voltage to lines 191 and 192.

Accordingly, when the switch 188 is closed, DC voltage is available between the lines 191 and 192. Thus, when the switch 89 is closed due to the measured portion of the strip 11 (see FIG. 1) of material being thicker than the predetermined thickness, a relay 193 (see FIG. 6) is energized since a normally closed switch 194 is closed. The switch 194, which is supported by the switch plate 109 (see FIG. 1) and closed during most of a cycle of operation, is closed during the feed portion of the cycle when measurement of the thickness of the strip 11 of material is occurring as the strip 11 of material passes beneath the sensor finger 78. Accordingly, when the thickness of the strip 11 of material exceeds the predetermined thickness, a circuit is completed from the line 191 (see FIG. 6) through the closed switch 89, the normally closed switch 194, and the relay 193 to the line 192 to energize the relay 193.

The switch 194 is opened by the cam profile 41 (see FIG. 1) of the cam 37. The cam profile 41 is designed to open the switch 194 after the signal is transferred from the relay 193 (see FIG. 6) to a relay 197 during the cycle of operation in which the portion of the strip 11 (see FIG. 1) exceeding the predetermined thickness is to be cut.

When the relay 193 (see FIG. 6) is activated, its normally open contact 198 is closed. This provides a hold circuit for the relay 193 if the switch 89 opens due to the thickness of the strip 11 (see FIG. 1) of material no longer exceeding the predetermined thickness during the feed portion of the cycle of operation.

If the relay 197 (see FIG. 6) was energized during the prior cycle of operation, a normally open contact 199 of the relay 197 was closed to maintain the relay 197 energized. While it is necessary to inactivate the relay 197 if the relay 193 was not energized during the prior cycle of operation because the switch 89 was not closed, it is not desired to inactivate the relay 197 if the relay 193 was energized during the prior cycle of operation. Thus, inactivation of the relay 197, if it is to occur, must occur during the time when the signal would be transferred from the relay 193 to the relay 197. Accordingly, a switch 200 is opened by the cam profile 41 (see FIG. 1) of the cam 37 after a switch 201, which is beneath the switch 200 to support the switch 200 and is supported on the platform 14 (see FIG. 1), is closed by the cam profile 42 of the cam 37. Thus, shortly before the switch 200 is opened by the cam profile 41 of the cam 37, the switch 201 is closed. If the relay 193 was energized during the feed portion of a cycle of operation when the thickness of the strip 11 (see FIG. 1) of material was measured, then the relay 197 (see FIG. 6) remains energized, if it was energized during the prior cycle of operation, when the switch 200 is opened since the switch 201 is closed to complete a circuit through a normally open contact 202 of the relay 193, the switch 201, a line 203, and the relay 197. If the relay 197 was not energized during the prior cycle of operation, it is energized by closing of the switch 201.

Energization of the relay 197 closes its normally open contact 199 to provide the hold circuit for the relay 197 through the normally closed switch 200, the normally open contact 199 of the relay 197, and the relay 197. This hold circuit for the relay 197 is provided prior to the normally open switch 201 being returned to its open position after closing by rotation of the cam 37 (see FIG. 1) so that the relay 197 (see FIG. 6) remains activated during the next cycle of operation until the switch 200 is opened and will stay activated if the relay 193 has been energized.

Shortly after the switch 201 is closed, the switch 194 is opened for a short period of time by the cam profile 41 (see FIG. 1) of the cam 37. This inactivates the relay 193 (see FIG. 6) so that it may be energized during pulling of the strip 11 (see FIG. 1) of material by the gripper 102 in the same cycle of operation if the thickness of the strip 11 of material exceeds the predetermined thickness.

When the relay 197 (see FIG. 6) is energized so that its normally open contact 199 is closed, the solenoid valve 175 is energized to move the latch 179 (see FIG. 1) into the path of travel of the frame 46 to prevent advancement of the frame 46 to the left in FIG. 1. The energization of the relay 197 (see FIG. 6) occurs only after the frame 46 (see FIG. 1) has completed its movement to the left in FIG. 1 and its return to the right to the position of FIG. 1 during the cycle of operation in which the strip 11 of material exceeding the predetermined thickness is to be cut. The inactivation of the relay 197 (see FIG. 6), if it was energized during the prior cycle of operation, by the opening of the normally closed switch 200 also occurs after the frame 46 (see FIG. 1) would have completed its reciprocating travel and returned to the position shown in FIG. 1.

As previously mentioned, the folded cut segment 12 (see FIG. 9), which is moved to the sewing machine 23 (see FIG. 7) by the frame 46 (see FIG. 1) being advanced to the left in FIG. 1, is retained at the sewing machine 23 (see FIG. 7) for sewing to material supported on a sewing plate 220 by a needle 221, which is mounted on a sewing head 222 for reciprocation in the well-known manner. One suitable example of the sewing machine 23 is a bar tacker sewing machine sold by Singer as model 369 type and modified for use with the apparatus 10 (see FIG. 1).

Figure 7:
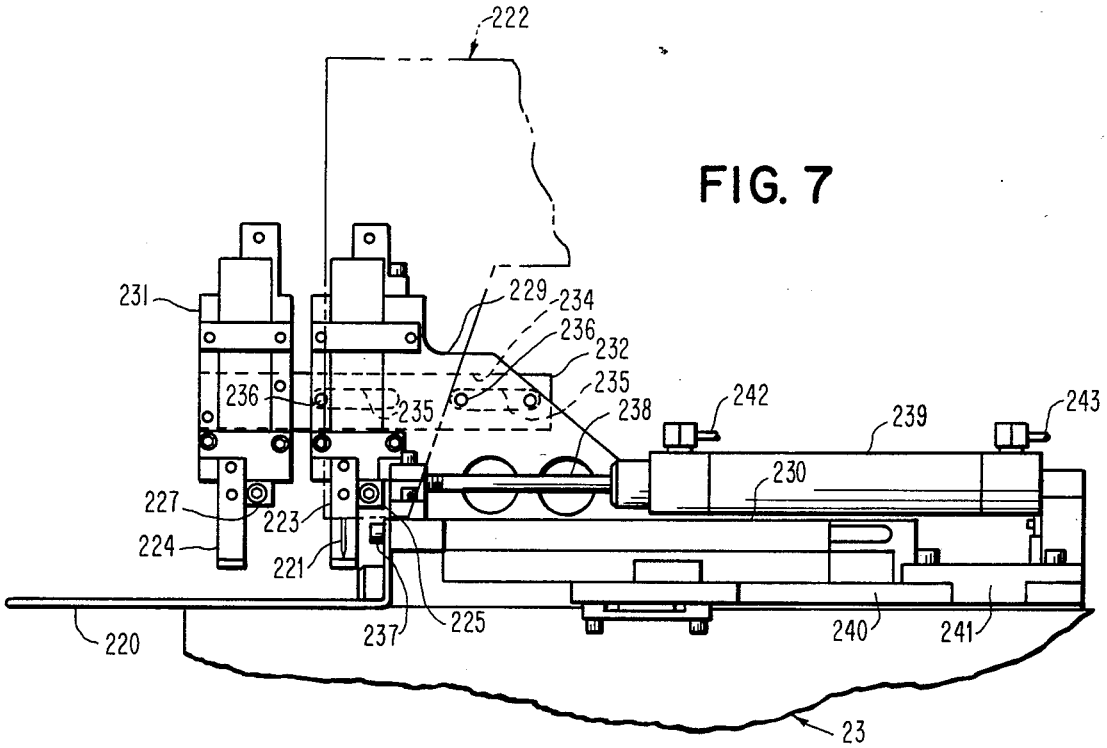
FIG. 7 is a side elevational view of a portion of a sewing machine with parts omitted for clarity purposes and used for sewing the folded cut segment produced by the apparatus of the present invention to another article of material.
Figure 8:
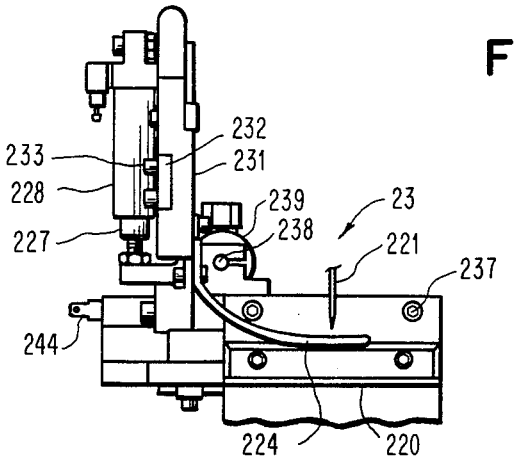
FIG. 8 is a front elevational view of the sewing machine of FIG. 7 with parts omitted for clarity purposes.

A presser foot 223 (see FIG. 7) and a presser foot 224 are employed to hold the folded cut segment 12 (see FIG. 9) against the material supported on the sewing plate 220 (see FIG. 7) prior to the frame 46 (see FIG. 1) being retracted so as to leave the folded cut segment 12 (see FIG. 9) retained at the sewing machine 23 (see FIG. 7). The presser foot 223 is supported on a piston rod 225 (see FIG. 10) of an air cylinder 226 for movement when pressurized air is supplied from the source to the top of the air cylinder 226 to move the rod 225 downwardly. The presser foot 224 (see FIG. 8) is supported on the bottom end of a piston rod 227 of an air cylinder 228 for downward movement when pressurized air is supplied from the source to the top of the air cylinder 228.

The air cylinder 226 (see FIG. 10) is supported on a support block 229 (see FIG. 7), which is connected to an elongated sliding plate 230 for movement therewith. The air cylinder 228 (see FIG. 8) is connected to a support block 231, which has an elongated bar 232 fixed thereto by screws 233 (see FIG. 8). The bar 232 is slidably mounted in a longitudinal slot 234 (see FIG. 7) in the support block 229 to enable adjustment of the presser foot 224 toward and away from the presser foot 223. The bar 232 has elongated slots 235 (see FIG. 7) therein to receive screws 236 for adjustably holding the support block 231 in its adjusted position relative to the support block 229.

Thus, the distance between the presser feet 223 and 224 is adjustable for various distances between the two ends of the folded cut segment 12 (see FIG. 9). This enables belt loops to be sewn to the material on the sewing plate 220 (see FIG. 7) at various distances to accommodate various width belts, for example.

The sliding plate 230, which has the sewing plate 220 secured thereto by screws 237, is connected to the end of a piston rod 238 of an air cylinder 239. The air cylinder 239 is fixed to a plate 240 having the sliding plate 230 slidable relative thereto. The plate 240 is mounted for pivotal movement about a pivot 241. This pivoting of the plate 240 about the pivot 241 is produced by the bar tacker.

Thus, when the needle 221 is disposed at the presser foot 223, as shown in FIG. 7, the piston rod 238 is extended the maximum from the air cylinder 239 and sewing occurs at one of the folded ends of the cut segment 12 (see FIG. 9). When the presser foot 224 (see FIG. 7) is at the needle 221 through retraction of the piston rod 238 into the air cylinder 239 by pressurized air being supplied through a hose 242 and removed through a hose 243, sewing occurs at the second of the folded ends of the cut segment 12 (see FIG. 9) after a switch 244 (see FIG. 8) is engaged to indicate that the presser foot 224 (see FIG. 7) is at the needle 221. In each of the positions of the presser feet 223 and 224 relative to the needle 221, the plate 240 is moved about the pivot 241 to cause the sewing.

Considering the operation of the apparatus of the present invention, each cycle of operation begins with an operator at the sewing machine 23 closing the switch 24 (see FIG. 6) to start a cycle of operation of the motor 25. Each cycle of operation is one revolution of the motor 25.

When the switch 24 is closed, a relay 245 is energized to close a normally open contact 245' of the relay 245 to complete a circuit through the motor 25 between the lines 186 and 187. When the relay 245 is energized, a normally open contact 246 is closed to provide a hold circuit for the relay 245 through the switch 163, which is closed during the cycle of operation.

The relay 245 also has a hold circuit through a normally open contact 246' of the relay 197 when the relay 197 is energized at the time that the switch 163 is opened at the completion of a revolution of the motor 25. With the relay 197 activated prior to the end of a cycle of operation because of the thickness of the strip 11 (see FIG. 1) of material to be cut during the same cycle of operation exceeding the predetermined thickness, the opening of the switch 163 (see FIG. 6) at the end of a revolution of the motor 25 does not stop the motor 25. Since the switch 163 closes shortly after the start of another cycle of operation, the closed contact 246' of the relay 197 holds the relay 245 closed until the switch 163 closes although the relay 197 is inactivated during the next cycle of operation if the cut segment 12 is satisfactory. Accordingly, this insures that the motor 25 makes an additional cycle of revolution whenever the cut segment 12 (see FIG. 9) is discarded because its thickness exceeded the predetermined thickness so that the pins 148–151 have a satisfactory one of the folded cut segments 12 thereon when the motor 25 is inactivated.

At this time, the folded cut segment 12 (see FIG. 9) is held on the pins 148–151 and retained between the fingers 139 and 140 with the frame 46 (see FIG. 1) to the left of the position shown in FIG. 1. Accordingly, when the motor 25 (see FIG. 3) begins its cycle of revolution, the cam shaft 28 is rotated counterclockwise (as viewed in FIG. 1) to start movement of the frame 46 to the left in FIG. 1 to the sewing machine 23 (see FIG. 7).

When the frame 46 (see FIG. 1) completes its movement to the left in FIG. 1, the folded cut segment 12 (see FIG. 9) is positioned beneath the presser feet 223 (see FIG. 7) and 224 and on top of the material resting on the sewing plate 220 to which the folded cut segment 12 (see FIG. 9) is to be sewed by the needle 221 (see FIG. 7). When the frame 46 (see FIG. 1) has completed the movement to the left in FIG. 1, the switch 165 is closed by the block 136 on the frame 46 engaging the plunger 164 of the switch 165.

The closing of the switch 165 energizes a solenoid valve 247 (see FIG. 6) to cause a four-way pilot valve 247' (see FIG. 10), which is held in each of the two positions by detents, to shift to a position in which pressurized air is supplied to the upper ends of the air cylinders 226 and 228 to which the presser feet 223 (see FIG. 7) and 224, respectively, are connected through a hose 248 (see FIG. 10). Thus, the presser feet 223 (see FIG. 7) and 224 clamp the folded cut segment 12 (see FIG. 9) to the sewing plate 220 (see FIG. 7) to retain the folded cut segment 12 (see FIG. 9) on top of the material to which the folded cut segment 12 is to be sewed by the needle 221 (see FIG. 7).

The pressurized air in the hose 248 (see FIG. 10) causes a pressure sensing switch 248' to close to indicate that the presser feet 223 (see FIG. 7) and 224 have been moved downwardly to their clamping positions. The closing of the pressure sensing switch 248' (see FIG. 10) energizes a solenoid valve 249 to shift the position of a fluid control valve 250 to supply air to an air cylinder 251 for moving various elements of the sewing machine into the sewing position. One suitable example of the valve 250 is sold by Clippard Instrument Laboratory, Inc., Cincinnati, Ohio as model 341. The valve 250 has a time delay output so that it remains in the position to which it is shifted when the solenoid valve 249 is open for a sufficient period of time to enable sewing to be completed with the presser foot 223 (see FIG. 7) at the needle 221.

The solenoid valve 249 (see FIG. 6) is energized when the pressure sensing switch 248' is closed upon the switch 168 being closed by retraction of the frame 46 (see FIG. 1) causing the plate 170 to engage the arm 169 of the switch 168. Since the switch 168 opens after the arm 169 is no longer engaged by the plate 170, the momentary opening of the solenoid valve 249 (see FIG. 10) due to its energization is sufficient to cause the valve 250 to supply compressed air for a sufficient period of time to the air cylinder 251 to complete sewing when the needle 221 (see FIG. 7) is cooperating with the presser foot 223.

When the switch 165 (see FIG. 1) is closed, the cam profile 39 of the cam 37 causes the opening of the switch 145 to shift the position of the three-way valve 143 through opening the solenoid valve 145' (see FIG. 6). This releases the fingers 139 (see FIG. 9) and 140 from clamping engagement with the folded cut segment 12 and also lifts the upper cutting blade 48 (see FIG. 2) upwardly from the lower fixed cutting blade 47.

When the presser feet 223 (see FIG. 7) and 224 have completed their downward movement, there is a slight time interval before the profile of the cam 44 (see FIG. 1) causes the frame 46 to begin to retract from the sewing machine 23 (see FIG. 7). This retraction of the frame 46 (see FIG. 1) withdraws the fingers 139 (see FIG. 9) and 140 and the pins 148–151 from the folded cut segment 12, which is now retained at the sewing machine 23 (see FIG. 7) by the presser feet 223 and 224. Sewing at the sewing machine 23 is delayed slightly after retraction of the frame 46 (see FIG. 1) starts until the arm 169 of the switch 168 is moved inwardly by the plate 170 on the frame 46 to close the switch 168 to energize the solenoid valve 249 (see FIG. 10) to shift the valve 250 to enable pressurized air to be supplied to the air cylinder 251. This insures that there is retraction of the fingers 139 (see FIG. 9) and 140 and the pins 148–151 from the folded cut segment 12 prior to any sewing.

At the start of the sewing cycle, the switch 244 (see FIG. 6) is in engagement with a contact 253 since the rod 238 (see FIG. 7) is not retracted into the air cylinder 239 to have the presser foot 224 at the needle 221. When the sewing cycle starts, a switch 254 (see FIG. 6) is moved into engagement with a contact 255 by the operation of the sewing machine 23 (see FIG. 7) so that a relay 256 (see FIG. 6) is energized just after a sewing cycle starts.

The energization of the relay 256 causes its normally open contacts 257 and 258 to close. The normally open contact 257 provides a hold circuit for the relay 256 so that it remains energized when the switch 254 moves from engagement with the contact 255 into engagement with a contact 259 at the completion of sewing by the needle 221 (see FIG. 7) when the presser foot 223 is cooperating therewith.

During the sewing cycle, the needle 221 sews one end of the folded cut segment 12 (see FIG. 9) to the garment on the sewing plate 220 (see FIG. 7) with the presser foot 223 at the needle 220. Upon completion of sewing of one end of the folded cut segment 12 (see FIG. 9) to the garment on the sewing plate 220 (see FIG. 7) with the presser foot 223 at the needle 221, the switch 254 (see FIG. 6) is moved into engagement with the contact 259 to energize a solenoid valve 260 through the contact 258 of the relay 256. This shifts the position of a four-way pilot valve 261 (see FIG. 10), which is held in each of its two positions by detents. This positioning of the four-way pilot valve 261 enables pressurized air to be supplied through the hose 242 at one end of the air cylinder 239 and removed from the other end of the air cylinder 239 through the hose 243. This retracts the rod 238 (see FIG. 7) into the air cylinder 239 to position the presser foot 224 at the needle 221.

When the switch 244 (see FIGS. 6 and 8) is engaged upon the air cylinder 239 (see FIG. 7) retracting the rod 238 to the position in which the presser foot 224 is disposed at the needle 221, the switch 244 (see FIG. 6) is moved from engagement with the contact 253 into engagement with a contact 262. This deenergizes the relay 256 whereby the normally open contacts 257 and 258 of the relay 256 open. As a result of the contact 258 of the relay 256 opening, the solenoid valve 260 is deenergized, but the four-way pilot valve 261 (see FIG. 10) remains in the position to which it has been moved by being retained by the detent so that the presser foot 224 (see FIG. 7) remains disposed at the needle 221. The opening of the contact 257 (see FIG. 6) of the relay 256 breaks the hold circuit for the relay 256.

When the switch 244 is moved into engagement with the contact 262, a relay 263 is energized through a normally open contact 264 of a relay 265 and a switch 266, which is connected to the switch 254 so that they move together, engaging a contact 267. The switch 266 is moved away from engagement with a contact 268 and into engagement with the contact 267 at the completion of each sewing cycle so that the switch 266 engages the contact 267 at the end of the first sewing cycle when sewing has been completed with the presser foot 223 (see FIG. 7) at the needle 221.

Energization of the relay 263 closes its normally open contacts 269 and 270. The closing of the contact 269 energizes the solenoid valve 249 to again move the valve 250 (see FIG. 10) to allow pressurized air to be supplied to the air cylinder 251 for a predetermined period of time to have sewing with the presser foot 224 at the needle 221. The closing of the normally open contact 270 energizes a counter 271 to advance its count by the count of one. One suitable example of the counter 271 is a Veeder/Root series 7440 counter.

When the counter 271 reaches a predetermined count, a switch 272 in the counter 271 is closed to energize a lamp 273. This indicates to the operator that it is time to replace the bobbin with more thread.

As soon as sewing of the other of the ends of the folded cut segment 12 (see FIG. 9) by the needle 221 (see FIG. 7) begins with the presser foot 224 at the needle 221, the switch 266 (see FIG. 6) moves from its rest position in which it engages the contact 267 into engagement with the contact 268. This movement is produced by the sewing machine 23 (see FIG. 7).

The engagement of the switch 266 (see FIG. 6) with the contact 268 completes a circuit through the relay 265 and the switch 244 to energize the relay 265. This causes the normally open contact 264 of the relay 265 and a normally open contact 274 of the relay 265 to close. Closing of the contact 264 of the relay 265 inactivates the relay 263 so that the solenoid valve 249 is only momentarily energized and closing of the contact 274 provides a hold circuit for the relay 265.

Accordingly, when the second sewing cycle is completed by the needle 221 (see FIG. 7) with the presser foot 224 at the needle 221, the switch 266 (see FIG. 6) returns into engagement with the contact 267 to energize solenoid valves 275 and 276 through the closed contact 264 of the relay 265. The energization of the solenoid valve 275 supplies pressurized air to the four-way pilot valve 261 (see FIG. 10) to shift from the position in which it previously had been held by a detent to another position in which it is held by a second detent. This enables pressurized air to be supplied to the air cylinder 239 through the hose 243 and withdrawn from the air cylinder 239 through the hose 242. This extends the rod 238 (see FIG. 7) to dispose the presser feet 223 and 224 in the position of FIG. 7.

The energization of the solenoid valve 276 (see FIG. 10) supplies pressurized air to the four-way pilot valve 247' to shift from the position in which it previously had been held by a detent to another position in which it is held by a second detent. This enables pressurized air to be removed from the air cylinders 226 and 228 whereby the presser feet 223 (see FIG. 7) and 224 are raised by springs (not shown) in the air cylinders 226 (see FIG. 10) and 228. This also inactivates the sensing switch 248'.

Retraction of the frame 46 to the right in FIG. 1 continues until the frame 46 reaches the position of FIG. 1. At this time, the cam profile 40 of the cam 37 changes the on-off state of the switch 162 so that the three-way valve 159 is shifted. As a result, pressurized air is supplied through the hose 161 to the air cylinder 158 and withdrawn from the air cylinder 158 through the hose 160. This causes the pins 148 (see FIG. 4) and 149 and the pins 150 and 151 to be rotated in opposite directions to return to the positions in which they can receive the strip 11 (see FIG. 1) of material therebetween when the frame 46 is advanced to the left from the position of FIG. 1 to the position in which the pins 148 and 149 (see FIG. 4) and the pins 150 and 151 are disposed on opposite sides of the portion of the strip 11 (see FIG. 1) of material prior to it being cut.

When the frame 46 is retracted to the position of FIG. 1, the profile of the cam 43 causes the rod 63 to move towards the rear of the platform 14. This results in the rollar 70 engaging the pivotally mounted arm 71 to move the frame 77 towards the front of the platform 14. This advancement of the frame 77 against the force of the spring 98 advances the strip 11 of material the first selected distance past the cutting plane of the cutting blades 47 (see FIG. 2) and 48. The strip 11 (see FIG. 1) of material is held on the plate 76 of the frame 77 by the resiliently biased fingers 78 and 79. During this movement of the frame 77, there is no relative motion between the strip 11 and the frame 77.

At the completion of feeding of the strip 11 the first selected distance by the roller 70 pivoting the arm 71 to move the plate 76 of the frame 77, the jaws 100 (see FIG. 4) and 101 of the gripper 102 are positioned on opposite sides of the free end of the strip 11 (see FIG. 1) of material protruding beyond the cutting plane of the cutting blades 47 (see FIG. 2) and 48. Thus, the jaws 100 (see FIG. 4) and 101 of the gripper 102 do not enter the cutting plane of the cutting blades 47 (see FIG. 2) and 48.

When the inward movement of the gripper 102 (see FIG. 4) towards the cutting means 45 (see FIG. 2) has been completed by motion of the rod 63 (see FIG. 1) to the rear of the platform 14 so that the jaws 100 (see FIG. 2) and 101 are disposed on opposite sides of the free end of the strip 11 (see FIG. 1) of material protruding beyond the cutting plane of the cutting blades 47 (see FIG. 2) and 48, the cam profile 38 (see FIG. 1) of the cam 37 closes the switch 108 to energize the solenoid valve 105 to allow pressurized air to be supplied through the hose 106 to the air cylinder (not shown) in the support block 103 (see FIG. 5) to move the lower jaw 101 upwardly against the force of the spring 104 and against the upper jaw 100 to grip the free end of the strip 11 (see FIG. 1) of material therebetween. This occurs prior to the profile of the cam 43 causing motion of the rod 63 to begin towards the front of the platform 14. The forward motion of the rod 63 does not begin until a short period of time after the pressurized air has been supplied to the air cylinder (not shown) in the support block 103 (see FIG. 5) to cause the lower jaw 101 to move towards the upper jaw 100 to grip the free end of the strip 11 (see FIG. 1) of material therebetween.

After the rod 63 has been moved to its maximum forward position by the profile of the cam 43 so that the strip 11 of material is across the travel path of the frame 46, the frame 46 is advanced from the position of FIG. 1 towards the left. The amount of this advancement is controlled by the profile of the cam 44. At the completion of movement of the frame 46 to the left of the position of FIG. 1, the pins 148 (see FIG. 4) and 149, the pins 150 and 151, and the fingers 139 and 140 are disposed on opposite sides of the portion of the strip 11 (see FIG. 1) of material extending between the cutting blades 47 (see FIG. 2) and 48 and the gripper 102 (see FIG. 4).

Then, when movement of the frame 46 (see FIG. 1) is completed to the position in which the pins 148 (see FIG. 4) and 149, the pins 150 and 151, and the fingers 139 and 140 are disposed on opposite sides of the portion of the strip 11 (see FIG. 1) extending between the cutting blades 47 (see FIG. 2) and 48 and the gripper 102 (see FIG. 4), the cam profile 39 (see FIG. 1) of the cam 37 closes the switch 145 to energize the solenoid valve 145' (see FIG. 6) to shift the position of the three-way valve 143 (see FIG. 10) so that pressurized air is supplied to the air cylinder 141 to cause the finger 140 (see FIG. 4) to be moved towards the finger 139 to clamp the strip 11 (see FIG. 1) of material therebetween. This also allows supply of pressurized air to the upper end of the air-cylinder 50 and removal of pressurized air from the lower end of the air cylinder 50 to move the upper cutting blade 48 (see FIG. 2) downwardly into cutting engagement with the strip 11 (see FIG. 1) of material through cooperation with the fixed cutting blade 47 (see FIG. 2).

Thus, at the time that the upper cutting blade 48 moves into cutting engagement with the strip 11 (see FIG. 1) of material through cooperating with the lower fixed cutting blade 47 (see FIG. 2), the strip 11 (see FIG. 1) of material is retained or held between the fingers 139 (see FIG. 4) and 140. Therefore, the cut segment 12 (see FIG. 9) produced by the cutting means 45 (see FIG. 2) is retained between the fingers 139 (see FIG. 9) and 140. At this time, the ends of the cut segment 12 are disposed between the pins 148 and 149 and the pins 150 and 151.

After the cut segment 12 has been cut from the strip 11 (see FIG. 1) of material, the cam profile 40 of the cam 37 closes the switch 162. This shifts the position of the three-way valve 159 so that pressurized air is supplied through the hose 160 to the air cylinder 158 and removed from the hose 161. This causes rotation of the arms 146 and 147 through an angle greater than 180° to wrap the free ends of the cut segment 12 (see FIG. 9) about the pins 149 and 151. Thus, a folded loop is now ready to be transported to the sewing machine 23 (see FIG. 7). At this time, the cam profile 41 (see FIG. 1) of the cam 37 opens the switch 163 to inactivate the motor 25 (see FIG. 3) to stop rotation of the cam shaft 28 unless the the relay 197 (see FIG. 6) has been energized by the strip 11 (see FIG. 1) of material exceeding the predetermined thickness whereby the contact 246' (see FIG. 6) of the relay 197 is closed to cause another cycle of operation to automatically occur. Otherwise, another cycle of operation begins only when the operator at the sewing machine 23 (see FIG. 7) closes the switch 24 (see FIG. 6).

When the strip 11 (see FIG. 1) of material exceeds the predetermined thickness, the finger 78 moves the arm 84 so that the switch 89 is closed. This sensing occurs during the cycle prior to the cycle during which cutting of the portion of the strip 11 of material having its thickness sensed occurs.

Thus, if the portion of the strip 11 of material is sensed as being thicker than the predetermined thickness during the prior cycle of operation, then the solenoid valve 175 is activated by the normally open contact 199 (see FIG. 6) of the relay 197 being closed during the cycle of operation in which cutting of the thickened portion of the strip 11 (see FIG. 1) of material is to occur. The energization of the solenoid valve 175 allows pressurized air to be supplied to the air cylinder 177 to move the latch 179 against the force of the spring 181 to move the latch 179 to the position in which the latch 179 retains the frame 46 against movement to the left in FIG. 1. This energization of the solenoid valve 175 occurs during the cycle of operation after the frame 46 has returned to the position of FIG. 1. Therefore, during the cycle in which the sensed portion of the strip 11 of material is to be cut, after retraction of the frame 46 to the position of FIG. 1, the latch 179 retains the frame 46 in the position of FIG. 1.

The remainder of the cycle of operation is the same so that the sensed portion of the strip 11 of material is cut. However, this cut portion of the strip 11 of material falls downwardly since the fingers 139 (see FIG. 4) and 140 and the pins 148–151 have not been disposed on opposite sides of the strip 11 (see FIG. 1) of material prior to its being cut because of the latch 179 preventing advancement of the frame 46 to the left in FIG. 1 from the position of FIG. 1.

When the switch 188 (see FIG. 6) is closed so that DC voltage is applied between the lines 191 and 192, a lamp 277 is turned on to indicate to the operator that the power is applied. Whenever the thickness of the strip 11 (see FIG. 1) of material exceeds the predetermined thickness so that the relay 193 is energized, a lamp 278 is energized through the switch 89 closing or the normally open contact 198 of the relay 193 closing.

The lamp 278 informs the operator that the strip 11 of material is too thick and that the next cut segment 12 (see FIG. 9) will be discarded during an automatic cycle of operation without the operator having to close the switch 24 (see FIG. 6). When the lamp 277 is energized, the operator knows that the electrical circuit has power applied thereto.

When the strip 11 (see FIG. 1) of material is initially loaded, the finger 78 is moved so that the switch 89 (see FIG. 6) is closed to energize the relay 193. This would result in the initial cut segment 12 (see (FIG. 9) being discarded as being too thick. However, the initial portion of the strip 11 (see FIG. 1) of material would not be too thick. Accordingly, a normally closed push button switch 279 (see FIG. 6) is opened by the operator to clear the relay 193 so that the first cut segment 12 (see FIG. 9) can be used.

The number of the available cut segments 12 (see FIG. 9) for use as belt loops for a pair of pants is usually an even number whereas the number of belt loops used is an odd number, one less than the even number. Thus, it is desired to discard the remaining belt loop so that the used belt loops will be employed with the pair of pants formed from the same layer of material.

Accordingly, a normally open push button switch 280 (see FIG. 6) is in parallel with the switch 89. Closing of the push button switch 280 by the operator causes the remaining cut segment 12 (see FIG. 9) to be discarded as if it were too thick.

If desired, the apparatus of the present invention also could be utilized to sense when the strip 11 of material is less than a minimum thickness rather than greater than a predetermined thickness. This would occur where the strip 11 of material is formed by having thin threads connect the separate portions forming the strip 11 of material rather than having the separate portions forming the strip 11 of material overlap and sewed to each other. This would necessitate the switch 89 closing when the plunger 88 is moved inwardly rather than when the plunger 88 moves outwardly. Thus, the switch 89 would be responding to the thinner portion of the strip 11 of material rather than the thicker portion since it would be the thinner portion forming the connection and not usable rather than the overlapped thick portion.

An advantage of this invention is that the cutter cannot damage the feed means through inadvertent activation of the cutter. Another advantage of this invention is that all steps are controlled from a single cam shaft. A further advantage of this invention is that it reduces the number of air cylinders used.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. An apparatus for forming a segment cut from a strip of material with at least one end of the cut segment folded including:

cutting means to cut a segment of a selected length from the strip of material;

feed means to feed the strip of material a first selected distance along a first path past said cutting means;

gripping means to grip the strip of material after it has been fed past said cutting means the first selected distance by said feed means to pull the strip of material a second selected distance along the first path past said cutting means so that the sum of the first and second distances equals the selected length of the cut segment;

movable means movable along a second path substantially orthogonal to the first path along which the strip of material is pulled by said gripping means;

said movable means having holding means to hold the portion of the strip of material to be cut;

reciprocating means to advance said movable means along the second path to a first position in which said holding means holds the portion of the strip of material to be cut;

first rendering means to render said holding means effective to hold the portion of the strip of material to be cut when said cutting means cuts the strip of material to produce a cut segment held by said holding means;

folding means to fold the cut segment held by said holding means to form a loop at at least one end of the cut segment;

second rendering means to render said gripping means ineffective after said cutting means has cut the strip of material to form the cut segment and prior to said folding means being effective;

said reciprocating means advancing said movable means from the first position along the second path to a second position at which the folded cut segment is to be attached to other material after being retained at the second position;

said first rendering means rendering said holding means ineffective after the folded cut segment has been retained at the second position;

and said reciprocating means retracting said movable means along the second path to a third position more remote from the second position than the first position after said holding means has been rendered ineffective.

2. The apparatus according to claim 1 including preventing means to prevent said holding means from holding the strip of material when the thickness of the cut segment is not within a predetermined thickness range.

3. The apparatus according to claim 2 in which said preventing means includes advancement preventing means to prevent advancement of said movable means along the second path to the first position so that said holding means is prevented from reaching the position at which said holding means holds the portion of the strip of material to be cut.

4. The apparatus according to claim 3 in which said advancement preventing means includes:

sensing means to sense when the thickness of the segment to be cut is not within predetermined thickness range;

and mean responsive to said sensing means to lock said movable means in the third position.

5. The apparatus according to claim 1 in which said feed means includes:

slidable means;

releasably clamping means to releasably clamp the strip of material to said slidable means;

means to resiliently urge said slidable means to a first position;

and moving means to move said slidable means from its first position to a second position at which the strip of material has been fed the first selected distance past said cutting means.

6. The apparatus according to claim 5 in which:

said moving means of said feed means includes:

reciprocatory means;

and means mounted on said reciprocatory means to move said slidable means from its first position to its second position;

and said reciprocatory means of said moving means of said feed means has said gripping means mounted thereon for movement therewith.

7. The apparatus according to claim 5 in which:

said releasably clamping means of said feed means includes:

a finger;

means to pivotally mount said finger;

and means to continuously urge said finger toward said slidable means to hold the strip of material therebetween while allowing the strip of material to be pulled between said finger and said slidable means by said gripping means;

means is responsive to the position of said finger when the thickness of the strip of material passing therebeneath is not within the predetermined thickness range when the strip of material is pulled by said gripping means;

and said responsive means includes means to lock said movable means in the third position.

8. The apparatus according to claim 1 including said movable means supporting said folding means for movement with said movable means along the second path.

9. The apparatus according to claim 8 in which:

said movable means includes:

a frame to support said holding means and said folding means;

and means to slidably support said frame for movement along the second path;

and said folding means includes:

a pair of pins disposed on each side of said holding means;

each of said pairs of pins including a first pin and a second pin with said first pin being above said second pin and the strip of material disposed between said pins of each of said pairs of pins prior to cutting of the portion of the strip of material by said cutting means;

and means to cause rotation of each of said pairs of pins to wrap each end of the cut segment around said second pin of each of said pairs of pins by rotating said first pin from above said second pin to below said second pin.

10. The apparatus according to claim 1 including cam means to mechanically control said reciprocating means, said feed means, and said gripping means.

11. An apparatus for cutting a segment of a selected length from a strip of material and positioning the cut segment at a position at which the cut segment is to be attached to other material including:

cutting means to cut a segment of a selected length from the strip of material;

advancing means to advance the strip of material along a first path past said cutting means for the selected length;

movable means movable along a second path substantially orthogonal to the first path along which the strip of material is advanced by said advancing means;

said movable means including holding means to hold the portion of the strip of material to be cut;

cam means to control said holding means and said movable means so that said movable means is advanced along the second path to a first position in which said holding means holds the portion of the strip of material to be cut after said advancing means has advanced the selected length of the strip of material along the first path past said cutting means and across the second path;

said cam means including means to cause said holding means to hold the portion of the strip of material to be cut when said cutting means cuts the strip of material to produce a cut segment held by said holding means;

and said cam means including means to control the movement of said movable means from its first position to a second position in the same direction along the second path as said movable means was advanced from a third position to its first position and from its second position to its third position in the opposite direction after said holding means is rendered ineffective at the second position of said movable means to no longer hold the cut segment, the second position being the position at which the cut segment is attached to other material after being retained at the second position prior to said holding means being rendered ineffective.

12. The apparatus according to claim 29 in which said advancing means includes:

first means to advance the strip of material a first selected distance past said cutting means;

and second means to advance the strip of material a second selected distance past said cutting means so that the sum of the first and second selected distances equals the selected length of the cut segment.

13. The apparatus according to claim 12 in which said first means of said advancing means includes:

slidable means;

releasably clamping means to releasably clamp the strip of material to said slidable means;

means to resiliently urge said slidable means to a first position;

and moving means to move said slidable means from its first position to a second position at which the strip of material has been fed the first selected distance past said cutting means.

14. The apparatus according to claim 13 in which:

said moving means of said first means of said advancing means includes:

reciprocatory means;

and means mounted on said reciprocatory means to move said slidable means from its first position to its second position;

and said reciprocatory means of said moving means of said first means of said advancing means has said second means of said advancing means mounted thereon for movement therewith.

15. The apparatus according to claim 13 in which:

said releasably clamping means of said first means of said advancing means includes:

a finger;

means to pivotally mount said finger;

and means to continuously urge said finger towards said slidable means to hold the strip of material therebetween while allowing the strip of material to be pulled between said finger and said slidable means by said second means of said advancing means;

means is responsive to the position of said finger when the thickness of the strip of material passing therebeneath is not within the predetermined thickness range when the strip of material is advanced by said second means of said advancing means;

and said responsive means includes means to lock said movable means in the third position.

16. The apparatus according to claim 11 including preventing means to prevent said holding means from holding the strip of material when the thickness of the cut segment is not within a predetermined thickness range.

17. The apparatus according to claim 16 in which said preventing means includes advancement preventing means to prevent advancement of said movable means along the second path to its first position so that said holding means is prevented from reaching the position at which said holding means holds the portion of the strip of material to be cut.

18. The apparatus according to claim 17 in which said advancement preventing means includes:

sensing means to sense when the thickness of the segment to be cut is not within a predetermined thickness range;

and means responsive to said sensing means to lock said movable means in the third position.

19. The apparatus according to claim 11 said movable means supporting said folding means for movement with said movable means along the second path.

20. The apparatus according to claim 19 in which:

said movable means includes:

a frame to support said holding means and said folding means;

and means to slidably support said frame for movement along the second path;

and said folding means includes:

a pair of pins disposed on each side of said holding means;

each of said pairs of pins including a first pin and a second pin with said first pin being substantially above said second pin and the strip of material disposed between said pins of each of said pairs of pins prior to cutting of the strip of material by said cutting means;

and means to cause rotation of each of said pairs of pins to wrap each end of the cut segment around said second pin of each of said pairs of pins by rotating said first pin from above said second pin to below said second pin.

21. An apparatus for holding a cut segment of a selected length including:

support means;

clamping means supported by said support means to clamp a portion of a strip of material to be cut prior to the strip of material being cut to produce a cut segment of a selected length, said clamping means clamping the portion of the strip of material intermediate the ends of the cut segment to be produced from the strip of material;

folding means supported by said support means to fold the cut segment clamped by said clamping means to form a loop at at least one end of the cut segment after the strip of material has been cut to produce the cut segment;

means to mount said support means for reciprocating movement along a path substantially orthogonal to the strip of material to be cut to produce the cut segment to be clamped by said clamping means;

and means to cause reciprocating movement of said support means along the path from a first position at which the cut segment is produced from the strip of material by cutting to a second position at which the folded cut segment is to be attached to other material, from the second position to a third position more remote from the second position than the first position, and from the third position to the first position.

22. The apparatus according to claim 21 including means to render said clamping means ineffective after said support means is at the second position at which the folded cut segment is retained for attachment to the other material.

23. The apparatus according to claim 22 in which:

said clamping means includes:

a first finger for disposition on one side of the strip of material to be cut to produce a cut segment;

and a second finger for disposition on the other side of the strip of material to be cut to produce the cut segment;

and means to move at least one of said fingers to clamp the strip of material between said fingers prior to the strip of material being cut to produce the cut segment.

24. The apparatus according to claim 23 in which:

said folding means includes:

a pair of pins disposed on each side of said clamping means; one of said pins of each of said pairs of pins being disposed in substantially the same plane as one of said fingers of said clamping means and the other of said pins of each of said pairs of pins being disposed in substantially the same plane as the other of said fingers of said clamping means when said fingers are not in their clamping positions;

each of said pairs of pins including a first pin and a second pin with said first pin being substantially above said second pin and the strip of material disposed between said pins of each of said pairs of pins prior to cutting the strip of material to produce the cut segment;

and means to cause rotation of each of said pairs of pin to wrap each end of the cut segment around said second pin of each of said pairs of pins by rotating said first pin from above said second pin to below said second pin.

25. The apparatus according to claim 22 in which said folding means includes:

a pair of pins disposed on each side of said clamping means, one of said pins of each of said pairs of pins being disposed in substantially the same plane as one of said fingers of said clamping means and the other of said pins of each of said pairs of pins being disposed in substantially the same plane as the other of said fingers of said clamping means when said fingers are not in their clamping positions;

each of said pairs of pins including a first pin and a second pin with said first pin being substantially above said second pin and the strip of material disposed between said pins of each of said pairs of pins prior to cutting the strip of material to produce the cut segment;

and means to cause rotation of each of said pairs of pins to wrap each end of the cut segment around said second pin of each of said pairs of pins by rotating said first pin from above said second pin to below said second pin.

26. The apparatus according to claim 21 in which:

said clamping means includes:

a first finger for disposition on one side of the strip of material to be cut to produce the cut segment;

and a second finger for disposition on the other side of the strip of material to be cut to produce the cut segment;

and means to move at least one of said fingers to clamp the strip of material between said fingers prior to the strip of material being cut to produce the cut segments.

27. The apparatus according to claim 26 in which said folding means includes:

a pair of pins disposed on each side of said clamping means, one of said pins of each of said pairs of pins being disposed in substantially the same plane as one of said fingers of said clamping means and the other of said pins of each of said pairs of pins being disposed in substantially the same plane as the other of said fingers of said clamping means when said finger are not in their clamping positions;

each of said pairs of pins including a first pin and a second pin with said first pin being substantially above said second pin and the strip of material disposed between said pins of each of said pairs of pins prior to cutting the strip of material to produce the cut segment;

and means to cause rotation of each of said pairs of pins to wrap each end of the cut segment around said second pin of each of said pairs of pins by rotating said first pin from above said second pin to below said second pin.

28. The apparatus according to claim 11 including:

folding means to fold the cut segment held by said holding means to form a loop at at least one end of the cut segment;

and said cam means including means to render said folding means effective only after said cutting means has cut the portion of the strip of material to produce the cut segment.

29. An apparatus for cutting a segment of a selected length from a strip of material and positioning the cut segment at a position at which the cut segment is to be attached to other material including:

cutting means to cut a segment of a selected length from the strip of material;

feed means to feed the strip of material a first selected distance along a first path past said cutting means;

gripping means to grip the strip of material after it has been fed past said cutting means the first selected distance by said feed means to pull the strip of material a second selected distance along the first path past said cutting means so that the sum of the first and second distances equals the selected length of the cut segment;

movable means movable along a second path substantially orthogonal to the first path along which the strip of material is pulled by said gripping means;

said movable means having holding means to hold the portion of the strip of material to be cut;

reciprocating means to advance said movable means along the second path to a first position in which said holding means holds the portion of the strip of material to be cut;

first rendering means to render said holding means effective to hold the portion of the strip of material to be cut when said cutting means cuts the strip of material to produce a cut segment held by said holding means;

second rendering means to render said gripping means ineffective after said cutting means has cut the strip of material to form the cut segment;

said reciprocating means advancing said movable means from the first position along the second path to a second position at which the cut segment is to be attached to other material after being retained at the second position;

said first rendering means rendering said holding means ineffective after the cut segment has been retained at the second position;

and said reciprocating means retracting said movable means along the second path to a third position more remote from the second position than the first position after said holding means has been rendered ineffective.

30. An apparatus for holding a cut segment of a selected length for positioning at a position at which the cut segment is to be attached to other material including:

support means;

clamping means supported by said support means to clamp a portion of a strip of material to be cut prior to the strip of material being cut to produce a cut segment of a selected length, said clamping means clamping the portion of the strip of material imtermediate the ends of the cut segment to be produced from the strip of material;

means to mount said support means for reciprocating movement along a path substantially orthogonal to the strip of material to be cut to produce the cut segment to be clamped by said clamping means;

and means to cause reciprocating movement of said support means along the path from a first position at which the cut segment is produced from the strip of material by cutting to a second position at which the cut segment is to be attached to other material, from the second position to a third position more remote from the second position than the first position, and from the third position to the first position.

* * * * *

UNITED STATES PATENT AND TRADEMARK OFFICE

CERTIFICATE OF CORRECTION

PATENT NO. : 4,561,365

DATED : December 31, 1985

INVENTOR(S) : Volker Schmidt et al

It is certified that error appears in the above-identified patent and that said Letters Patent is hereby corrected as shown below:

In the Abstract, line 13, after "plate" insert --- for sewing ---.

Column 3, line 10, after "support" insert --- means ---.

Column 3, line 23, after "second" insert --- position ---.

Column 12, line 54, cancel the "period (.)" (second occurrence).

Column 20, line 42, cancel "the" (second occurrence).

Column 23, line 9, after "within" insert --- a ---.

Column 24, line 51, "29" should read --- 11 ---.

Column 25, line 51, after "11" insert --- including ---.

Column 26, line 50, cancel the "colon (:)"

Column 26, line 53, the "semi-colon (;)" should read a

--- comma (,) ---.

Column 26, line 67, "pin" should read --- pins ---.

UNITED STATES PATENT AND TRADEMARK OFFICE

CERTIFICATE OF CORRECTION

PATENT NO. : 4,561,365

DATED : December 31, 1985

INVENTOR(S) : Volker Schmidt et al

It is certified that error appears in the above-identified patent and that said Letters Patent is hereby corrected as shown below:

Column 27, line 34, "segments" should read --- segment ---.

Column 27, line 44, "finger" should read --- fingers ---.

Signed and Sealed this

*Fifteenth* Day of *April 1986*

[SEAL]

*Attest:*

DONALD J. QUIGG

*Attesting Officer*

*Commissioner of Patents and Trademarks*